US010957334B2

(12) United States Patent
Kim et al.

(10) Patent No.: US 10,957,334 B2
(45) Date of Patent: Mar. 23, 2021

(54) ACOUSTIC PATH MODELING FOR SIGNAL ENHANCEMENT

(71) Applicant: QUALCOMM Incorporated, San Diego, CA (US)

(72) Inventors: Lae-Hoon Kim, San Diego, CA (US); Sharon Kaziunas, Bangor, PA (US); Anne Katrin Konertz, Encinitas, CA (US); Erik Visser, San Diego, CA (US); Cheng-Yu Hung, San Diego, CA (US); Shuhua Zhang, San Diego, CA (US); Fatemeh Saki, San Diego, CA (US); Dongmei Wang, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 16/224,022

(22) Filed: Dec. 18, 2018

(65) Prior Publication Data

US 2020/0194021 A1 Jun. 18, 2020

(51) Int. Cl.

| | |
|---|---|
| ***H04R 3/00*** | (2006.01) |
| ***G10L 21/0216*** | (2013.01) |
| ***H04R 3/04*** | (2006.01) |
| ***H04R 5/033*** | (2006.01) |
| ***H04R 5/04*** | (2006.01) |

(52) U.S. Cl.

CPC ..... *G10L 21/0216* (2013.01); *H04R 3/005* (2013.01); *H04R 3/04* (2013.01); *H04R 5/033* (2013.01); *H04R 5/04* (2013.01); *G10L 2021/02165* (2013.01); *H04R 2420/07* (2013.01)

(58) Field of Classification Search

CPC . H04R 3/005; H04R 3/04; H04R 5/04; H04R 5/033; H04R 2420/07; G10K 11/1785; G10K 2210/1081

USPC ..... 381/74, 56–57, 77, 79–80, 71.1, 71.6, 381/71.12, 94.1–94.1, 311

See application file for complete search history.

(56) References Cited

U.S. PATENT DOCUMENTS

| | | | | |
|---|---|---|---|---|
| 10,332,538 | B1 * | 6/2019 | Dusan | G10L 21/0232 |
| 2012/0063610 | A1 | 3/2012 | Kaulberg et al. | |
| 2013/0094683 | A1 | 4/2013 | Hansen | |
| 2014/0219467 | A1 * | 8/2014 | Kurtz | H04R 3/12 381/74 |
| 2014/0270200 | A1 * | 9/2014 | Usher | G10L 25/78 381/57 |
| 2016/0180830 | A1 * | 6/2016 | Lu | G10K 11/17881 381/71.6 |

(Continued)

OTHER PUBLICATIONS

International Search Report and Written Opinion—PCT/US2019/066076—ISA/EPO—dated Apr. 8, 2020 (12 pp.).

*Primary Examiner* — Disler Paul
(74) *Attorney, Agent, or Firm* — Moore IP

(57) ABSTRACT

Methods, systems, computer-readable media, and apparatuses for signal enhancement are presented. One example of such an apparatus includes a receiver configured to produce a remote speech signal from information carried by a wireless signal; a signal canceller configured to perform a signal cancellation operation on a local speech signal to generate a room response; and a filter configured to filter the remote speech signal according to the room response to produce a filtered speech signal. In this example, the signal cancellation operation is based on the remote speech signal as a reference signal.

20 Claims, 22 Drawing Sheets

(56) References Cited

U.S. PATENT DOCUMENTS

2016/0192090 A1 6/2016 Gran et al.
2018/0359294 A1* 12/2018 Brown ..... H04L 65/403

* cited by examiner

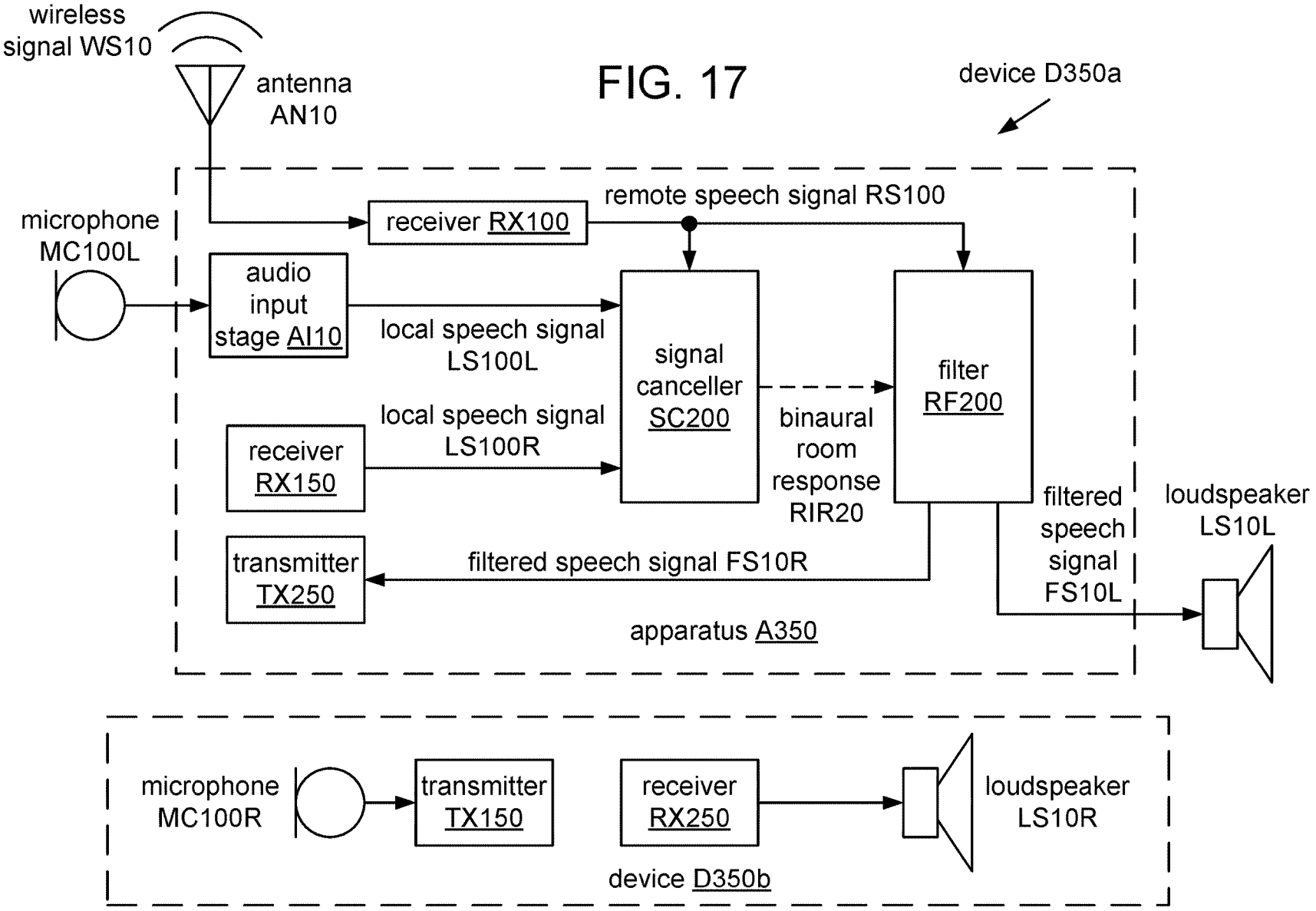
FIG. 17
device D350a
wireless signal WS10
antenna AN10
microphone MC100L
audio input stage AI10
receiver RX100
remote speech signal RS100
local speech signal LS100L
local speech signal LS100R
receiver RX150
transmitter TX250
signal canceller SC200
binaural room response RIR20
filter RF200
filtered speech signal FS10L
filtered speech signal FS10R
loudspeaker LS10L
apparatus A350
microphone MC100R
transmitter TX150
receiver RX250
loudspeaker LS10R
device D350b

ACOUSTIC PATH MODELING FOR SIGNAL ENHANCEMENT

FIELD OF THE DISCLOSURE

Aspects of the disclosure relate to audio signal processing.

BACKGROUND

Hearable devices or "hearables" (also known as "smart headphones," "smart earphones," or "smart earpieces") are becoming increasingly popular. Such devices, which are designed to be worn over the ear or in the ear, have been used for multiple purposes, including wireless transmission and fitness tracking. As shown in FIG. 3A, the hardware architecture of a hearable typically includes a loudspeaker to reproduce sound to a user's ear; a microphone to sense the user's voice and/or ambient sound; and signal processing circuitry to communicate with another device (e.g., a smartphone). A hearable may also include one or more sensors: for example, to track heart rate, to track physical activity (e.g., body motion), or to detect proximity.

BRIEF SUMMARY

A method of signal enhancement according to a general configuration includes receiving a local speech signal that includes speech information from a microphone output signal; producing a remote speech signal that includes speech information carried by a wireless signal; performing a signal cancellation operation, which is based on the remote speech signal as a reference signal, on at least the local speech signal to generate a room response; and filtering the remote speech signal according to the room response to produce a filtered speech signal. Computer-readable storage media comprising code which, when executed by at least one processor, causes the at least one processor to perform such a method are also disclosed.

An apparatus for signal enhancement according to a general configuration includes an audio input stage configured to produce a local speech signal that includes speech information from a microphone output signal; a receiver configured to produce a remote speech signal that includes speech information carried by a wireless signal; a signal canceller configured to perform a signal cancellation operation, which is based on the remote speech signal as a reference signal, on at least the local speech signal to generate a room response; and a filter configured to filter the remote speech signal according to the room response to produce a filtered speech signal. Implementations of such an apparatus as a memory configured to store computer-executable instructions and a processor coupled to the memory and configured to execute the computer-executable instructions to cause and/or perform such operations are also disclosed.

BRIEF DESCRIPTION OF THE DRAWINGS

Aspects of the disclosure are illustrated by way of example. In the accompanying figures, like reference numbers indicate similar elements.

FIG. 17 shows a block diagram of a device D350*a* that includes an implementation A350 of apparatus A300 and of an accompanying device D350*b*.

DETAILED DESCRIPTION

Figure 10:
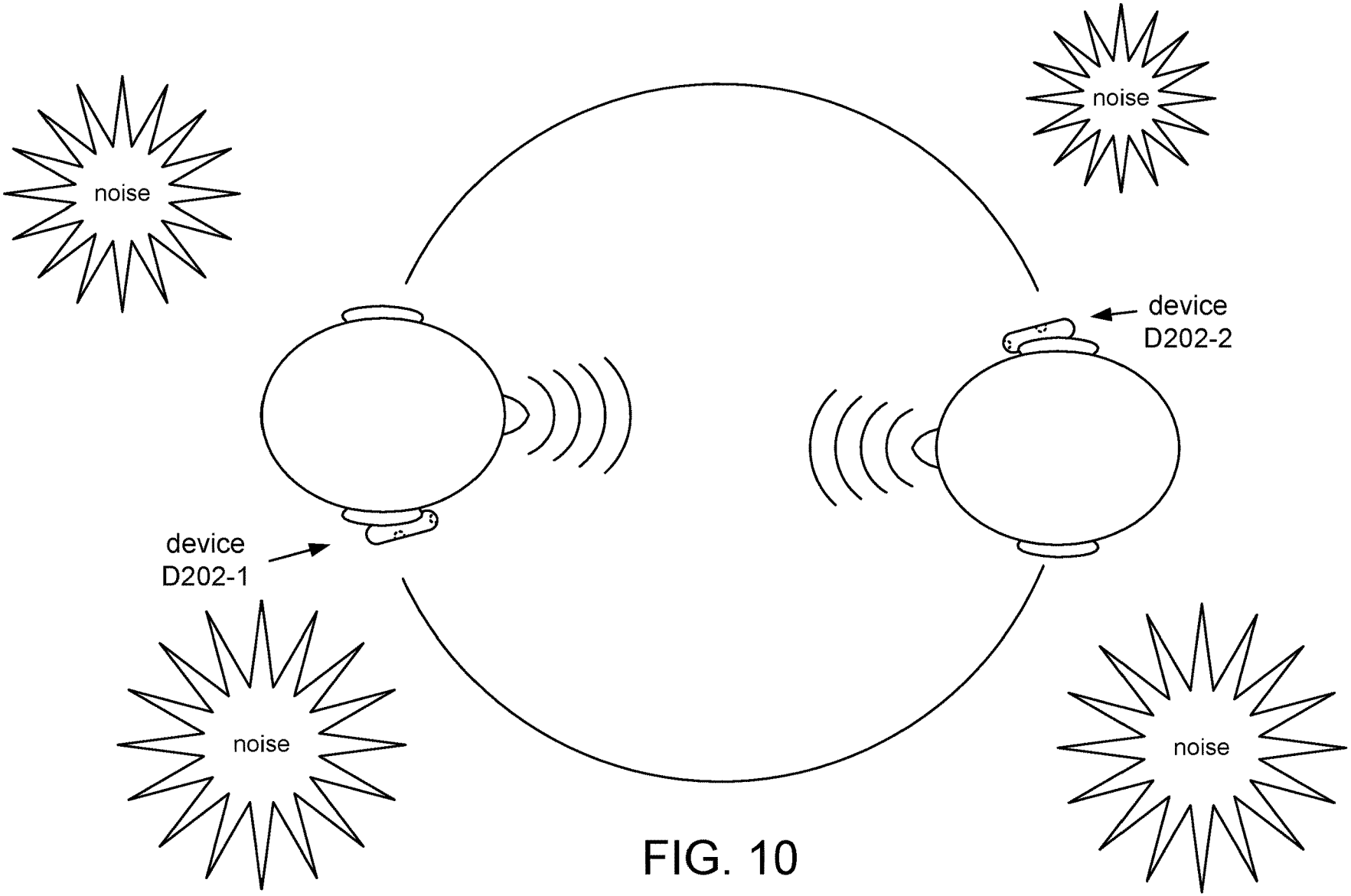
FIG. 10 shows an example of implementations D202-1, D202-2 of device D200 in use.

Methods, apparatus, and systems as disclosed herein include implementations that may be used to enhance an acoustic signal without degrading a natural spatial soundscape. Such techniques may be used, for example, to facilitate communication among two or more conversants in a noisy environment (e.g., as illustrated in FIG. 10).

Several illustrative embodiments will now be described with respect to the accompanying drawings, which form a part hereof. While particular embodiments, in which one or more aspects of the disclosure may be implemented, are described below, other embodiments may be used and various modifications may be made without departing from the scope of the disclosure or the spirit of the appended claims.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, estimating, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Unless expressly limited by its context, the term "determining" is used to indicate any of its ordinary meanings, such as deciding, establishing, concluding, calculating, selecting, and/or evaluating. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least." Unless otherwise indicated, the terms "at least one of A, B, and C," "one or more of A, B, and C," "at least one among A, B, and C," and "one or more among A, B, and C" indicate "A and/or B and/or C." Unless otherwise indicated, the terms "each of A, B, and C" and "each among A, B, and C" indicate "A and B and C."

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. A "task" having multiple subtasks is also a method. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose."

Unless initially introduced by a definite article, an ordinal term (e.g., "first," "second," "third," etc.) used to modify a claim element does not by itself indicate any priority or order of the claim element with respect to another, but rather merely distinguishes the claim element from another claim element having a same name (but for use of the ordinal term). Unless expressly limited by its context, each of the terms "plurality" and "set" is used herein to indicate an integer quantity that is greater than one.

In a first example, principles of signal enhancement as described herein are applied to an acoustic communication from a speaker to one or more listeners. Such application is then extended to acoustic communication among multiple (i.e., two or more) conversants.

Figure 1:
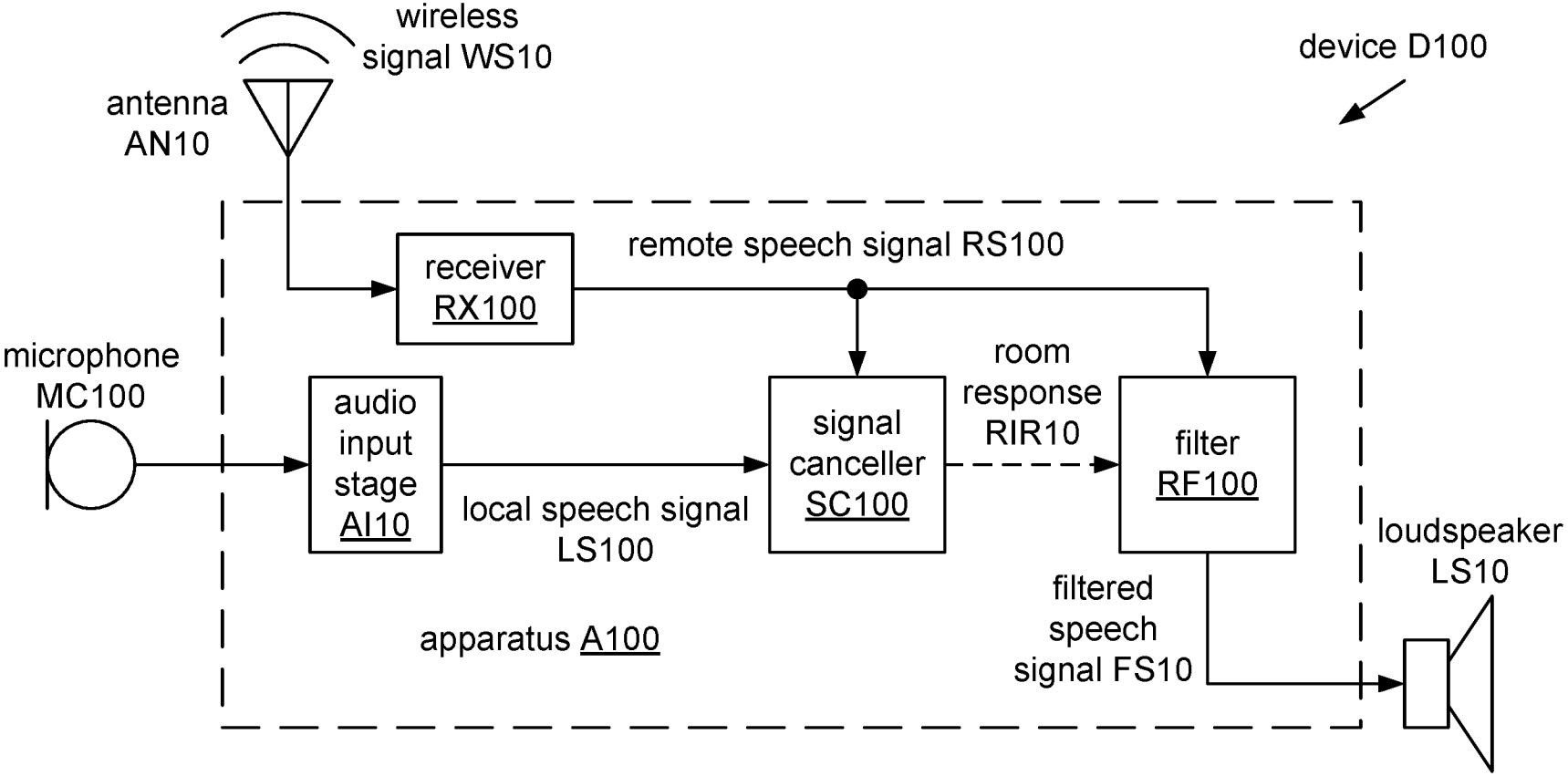
FIG. 1 shows a block diagram of a device D100 that includes an apparatus A100 according to a general configuration.

FIG. 1 shows a block diagram of a device D100 (e.g., a hearable) that includes an apparatus A100 according to a general configuration. Apparatus A100 includes a receiver RX100, an audio input stage AI10, a signal canceller SC100, and a filter RF100. Receiver RX100 is configured to produce a remote speech signal RS100 that includes speech information carried by a wireless signal WS10. Audio input stage AI10 is configured to produce a local speech signal LS100 that includes speech information from a microphone output signal. Signal canceller SC100 is configured to perform a signal cancellation operation, which is based on remote speech signal RS100 as a reference signal, on a local speech signal LS100 to generate a room response (e.g., a room impulse response) RIR10.

Filter RF100 is configured to filter remote speech signal RS100 according to room response RIR10 to produce a filtered speech signal FS10. In one example, signal canceller SC100 is implemented to generate room response RIR10 as a set of filter coefficient values that are updated and copied to filter RF100 periodically. In one example, the set of filter coefficient values is copied as a block, and in another example, the filter coefficient values are copied less than all at one time (e.g., individually or in subblocks).

Figure 8:
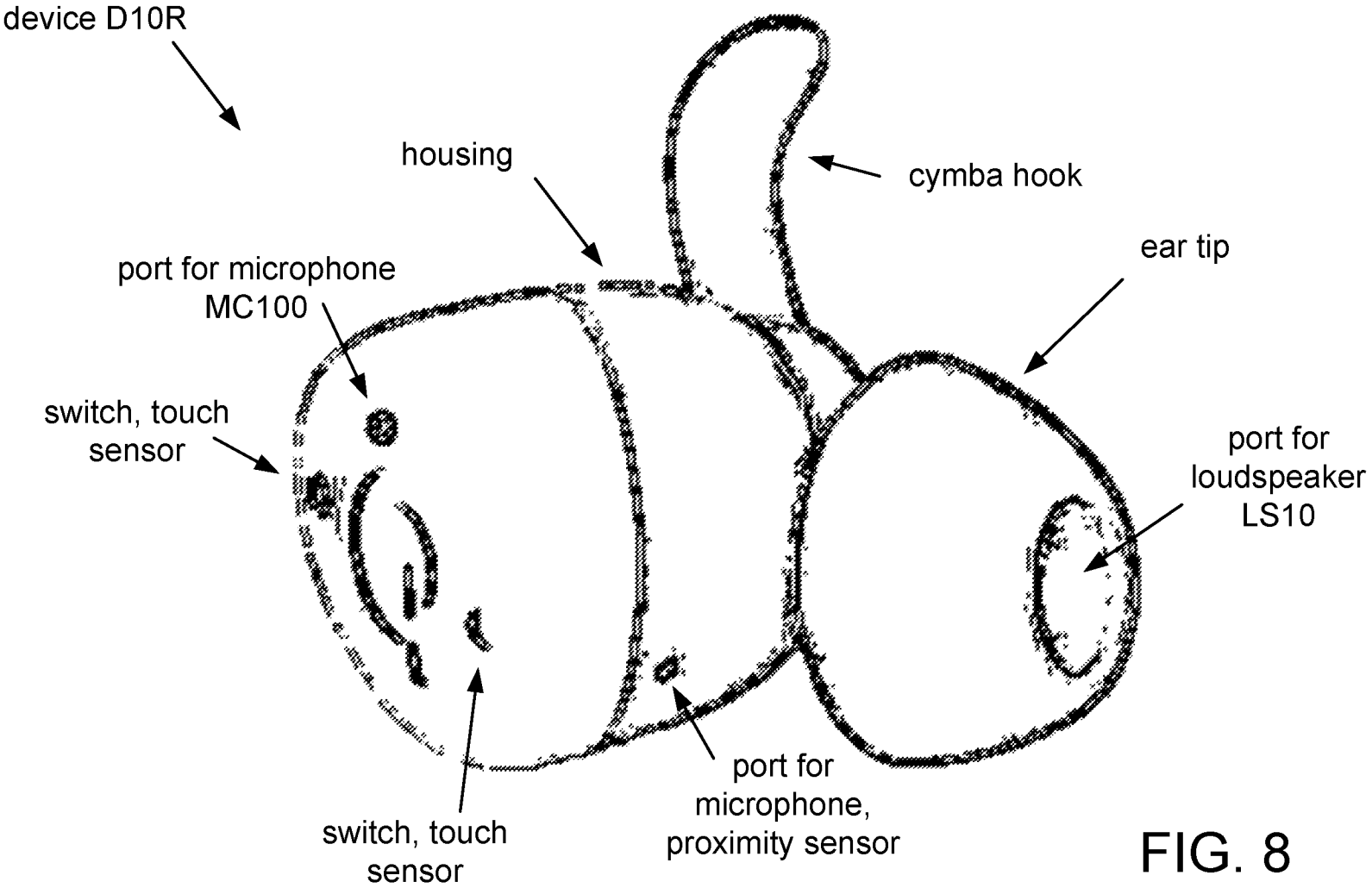
FIG. 8 shows a picture of one example of an implementation D10R of device D100 or D110.

Device D100 also includes an antenna AN10 to receive wireless signal WS10, a microphone MC100 to produce a microphone output signal upon which local speech signal LS100 is based, and a loudspeaker LS10 to reproduce an audio output signal that is based on filtered speech signal FS10. Device D100 is constructed such that microphone MC100 and loudspeaker LS10 are located near each other (e.g., on the same side of the user's head, such as at the same ear). It may be desirable to locate microphone MC100 close to the opening of an ear canal of the user and to locate loudspeaker LS10 at or within the same ear canal. FIG. 8 shows a picture of one example of an implementation D10R of device D100 to be worn at a user's right ear. Audio input stage AI10 may include one or more passive and/or active components to produce local speech signal LS100 from an output signal of microphone MC100 by performing any one or more of operations such as impedance matching, filtering, amplification, and/or equalization. In some implementations, audio input stage AI10 may be located at least in part within a housing of microphone MC100. A processor of apparatus A100 may be configured to receive local speech signal LS100 from a memory (e.g., a buffer) of the device.

Figure 2:
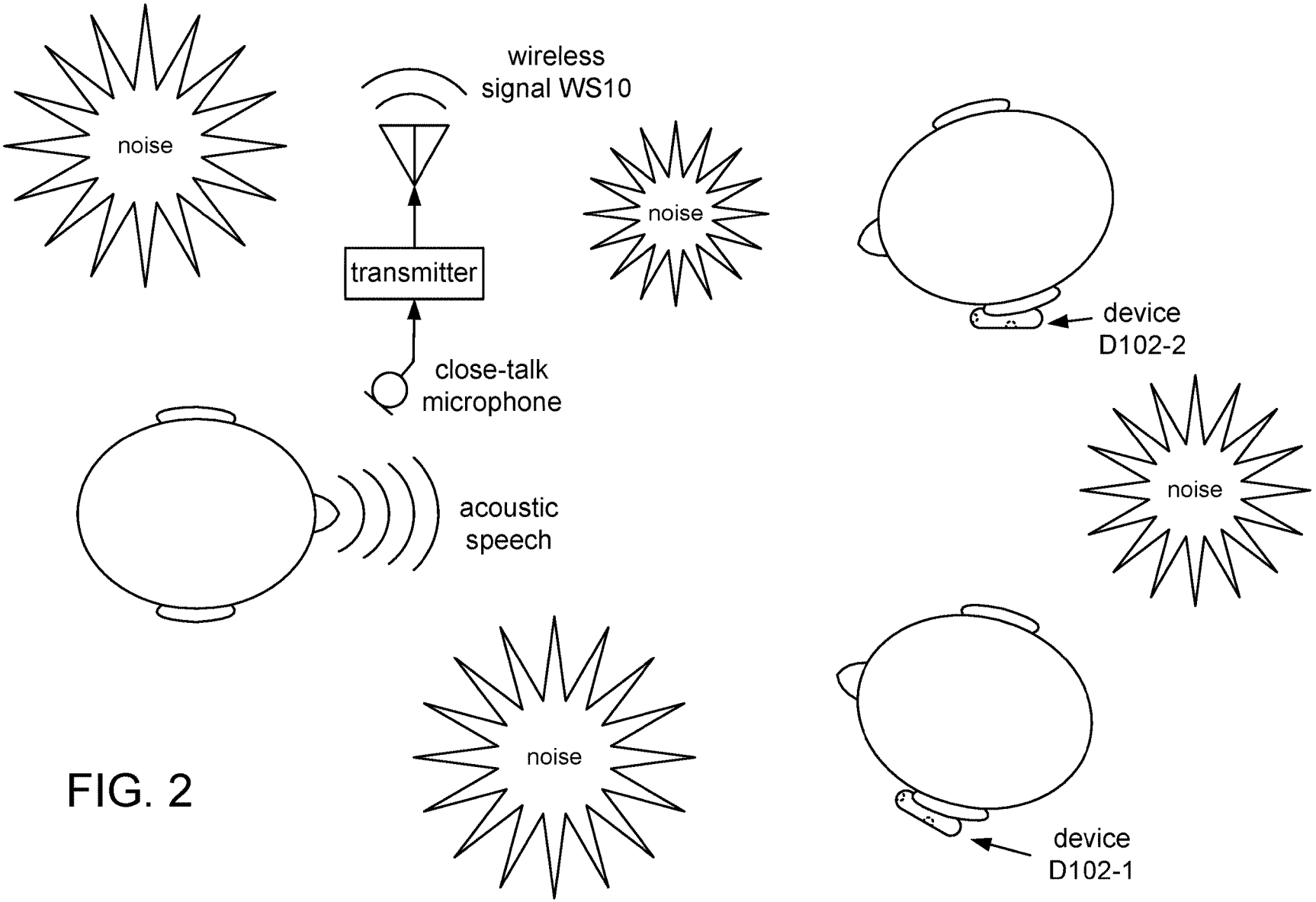
FIG. 2 illustrates a use case of device D100.

Typical use cases for such a device D100 or apparatus A100 include situations in which one person is speaking to several listeners in a noisy environment. For example, the speaker may be a lecturer, trainer, or other instructor talking to an audience of one or more people among other acoustic activity, such as in a multipurpose room or other shared space. FIG. 2 shows an example of such a use case in which each listener is wearing a respective instance D102-1, D102-2 of an implementation of device D100 at the user's left ear. Microphone MC100 of such a device may sense the speaker's voice (e.g., along with other ambient sounds and effects) such that a local speech signal based on an output signal of the microphone includes speech information from the acoustic speech signal of the speaker's voice.

As shown in FIG. 2, a close-talk microphone may be located close to the speaker's mouth in order to provide a good reference to signal canceller SC100 by sensing the speaker's voice as a direct-path acoustic signal with minimal reflection. Examples of microphones that may be used for the close-talk microphone include a lapel microphone, a pendant microphone, and a boom or mini-boom microphone worn on the speaker's head (e.g., on the speaker's ear). Other examples include a bone conduction microphone and an error microphone of an active noise cancellation (ANC) device.

Receiver RX100 may be implemented to receive wireless signal WS10 over any of a variety of different modalities. Wireless protocols that may be used by the transmitter to carry the speaker's voice over wireless signal WS10 include (without limitation) Bluetooth® (e.g., as specified by the Bluetooth Special Interest Group (SIG), Kirkland, Wash.), ZigBee (e.g., as specified by the Zigbee Alliance (Davis, Calif.), such as in Public Profile ID 0107: Telecom Applications (TA)), Wi-Fi (e.g., as specified in Institute of Electrical and Electronics Engineers (IEEE) Standard 802.11-2012, Piscataway, N.J.), and near-field communications (NFC; e.g., as defined in Standard ECMA-340, Near Field Communication Interface and Protocol (NFCIP-1; also known as ISO/IEC 18092), December 2004 and/or Standard ECMA-352, Near Field Communication Interface and Protocol-2 (NFCIP-2; also known as ISO/IEC 21481), December 2003 (Ecma International, Geneva, CH)). The carrier need not be a radio wave, and receiver RX100 may also be implemented to receive wireless signal WS10 via magnetic induction (e.g., near-field magnetic induction (NFMI) or a telecoil) and/or a light-wave carrier (e.g., as defined in one or more IrDA or Li-Fi specifications). For a case in which the speech information carried by wireless signal WS10 is in an encoded or 'compressed' form (e.g., according to a linear predictive and/or psychoacoustic coding scheme), receiver RX100 may include an appropriate decoder (e.g., a decoder compliant with a codec by which the speech information is encoded) or otherwise be configured to perform an appropriate decoding operation on the received signal.

Signal canceller SC100 may be implemented using any known echo canceller structure. Signal canceller SC100 may be configured to implement, for example, a least-mean-squares (LMS) algorithm (e.g., filtered-reference ("filtered-X") LMS, normalized LMS (NLMS), block NLMS, step size NLMS, sub-band LMS/NLMS, frequency-domain LMS/NLMS, etc.). Signal canceller SC100 may be implemented, for example, as a feedforward system. Signal canceller SC100 may be implemented to include one or more other features as known in the art of echo cancellers, such as, for example, double-talk detection (e.g., to inhibit filter adaptation while the user is speaking (i.e., when the user's own voice is also present in local speech signal LS100)) and/or path change detection (e.g., to allow quick re-convergence in response to echo path changes). In one example, signal canceller SC100 is a structure designed to model an acoustic path from a location of the close-talk microphone to microphone MC100.

Figure 3B:
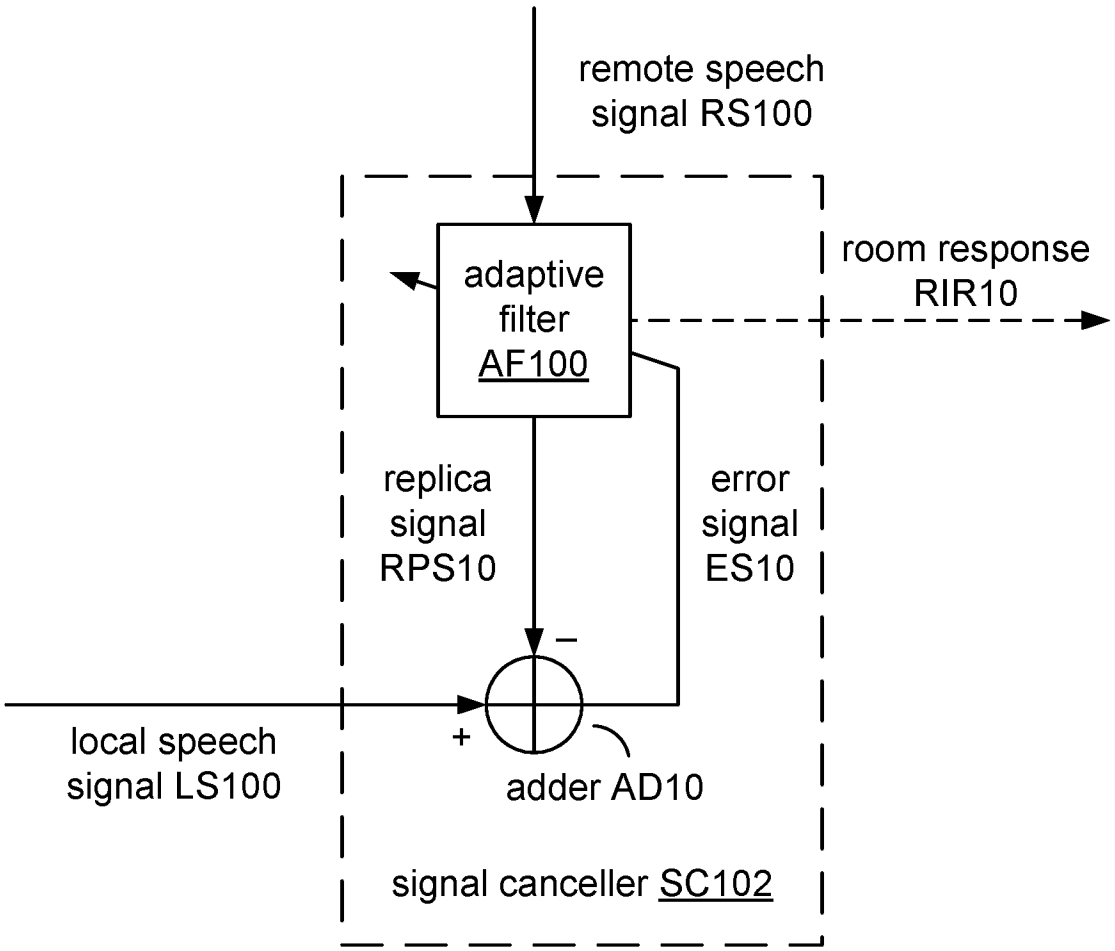
FIG. 3B shows a block diagram of an implementation SC102 of signal canceller SC100.
Figure 3A:
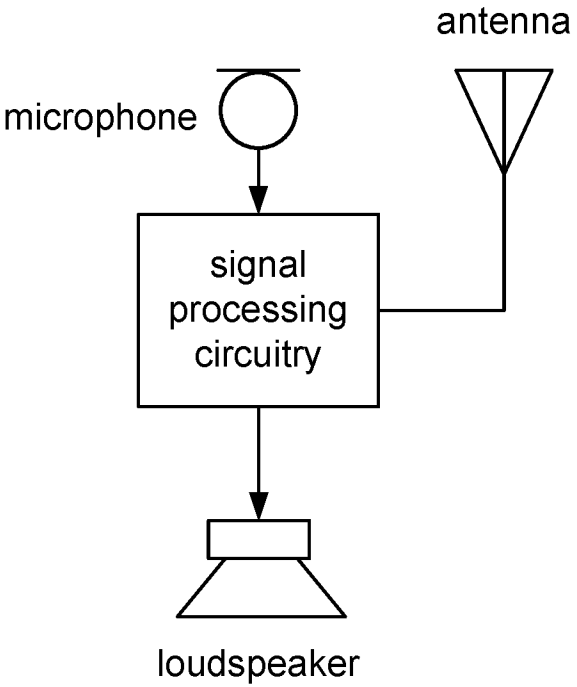
FIG. 3A shows a block diagram of a hearable.

FIG. 3B shows a block diagram of an implementation SC102 of signal canceller SC100 that includes an adaptive filter AF100 and an adder AD10. Adaptive filter AF100 is configured to filter remote speech signal RS100 to produce a replica signal RPS10, and adder AD10 is configured to subtract replica signal RPS10 from local speech signal LS100 to produce an error signal ES10. In this example, adaptive filter AF100 is configured to update the values of its filter coefficients based on error signal ES10.

Figure 4:
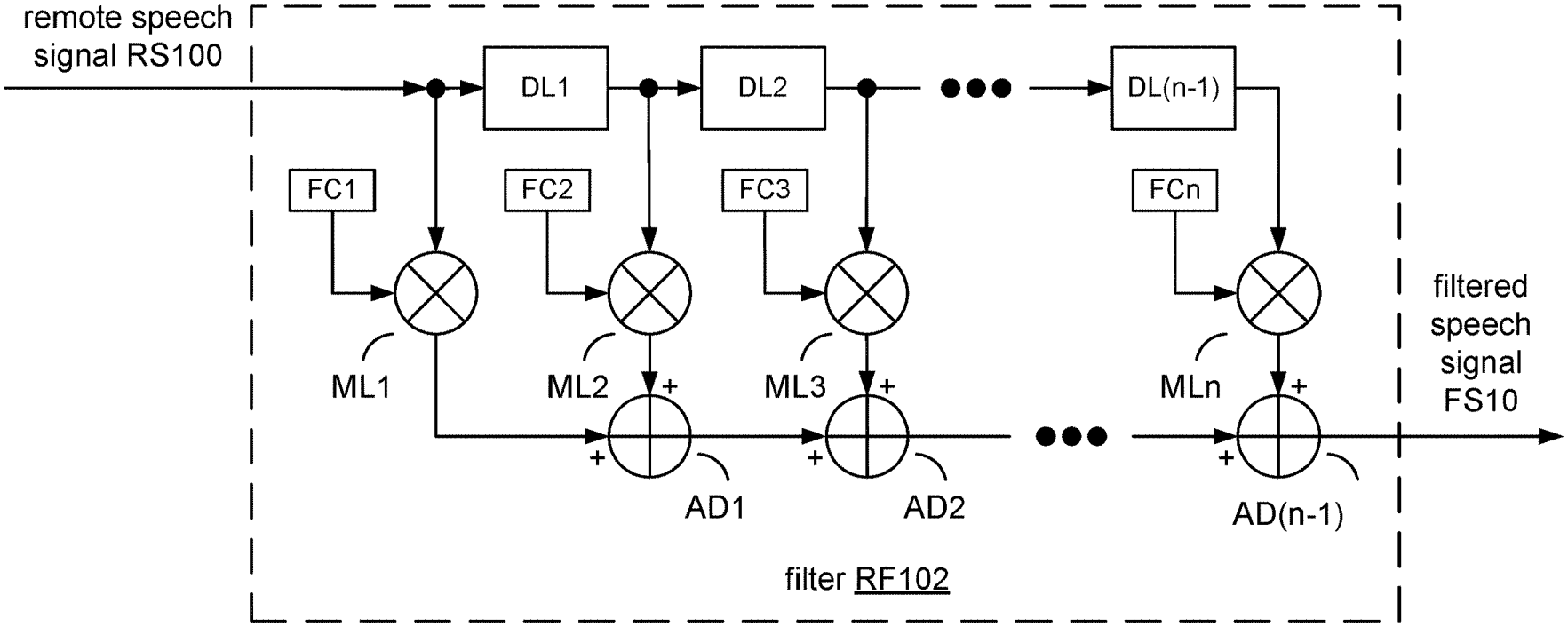
FIG. 4 shows a block diagram of an implementation RF102 of filter RF100.

The filter coefficients of adaptive filter AF100 may be arranged as, for example, a finite-impulse response (FIR) structure, an infinite-impulse response (IIR) structure, or a combination of two or more structures that may each be FIR or IIR. Typically, FIR structures are preferred for their inherent stability. Filter RF100 may be implemented to have the same arrangement of filter coefficients as adaptive filter AF100. FIG. 4 shows an implementation RF102 of filter RF100 as an n-tap FIR structure that includes delay elements DL1 to DL(n−1), multipliers ML1 to MLn, adders AD1 to AD(n−1), and storage for n filter coefficient values (e.g., room response RIR10) FC1 to FCn.

Figure 5:
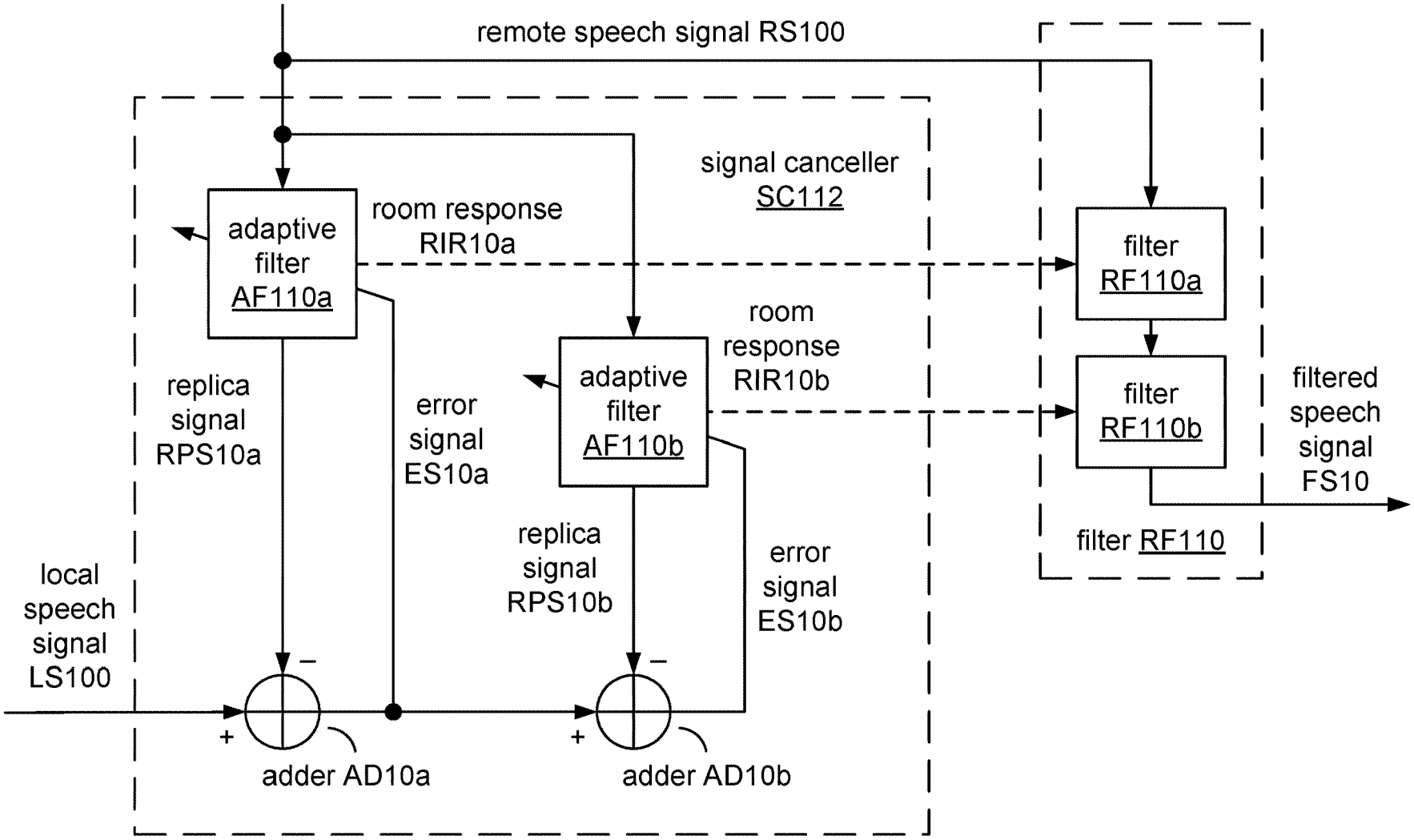
FIG. 5 shows a block diagram of an implementation SC112 of signal cancellers SC100 and SC102 and an implementation RF110 of filter RF100.
Figure 6:
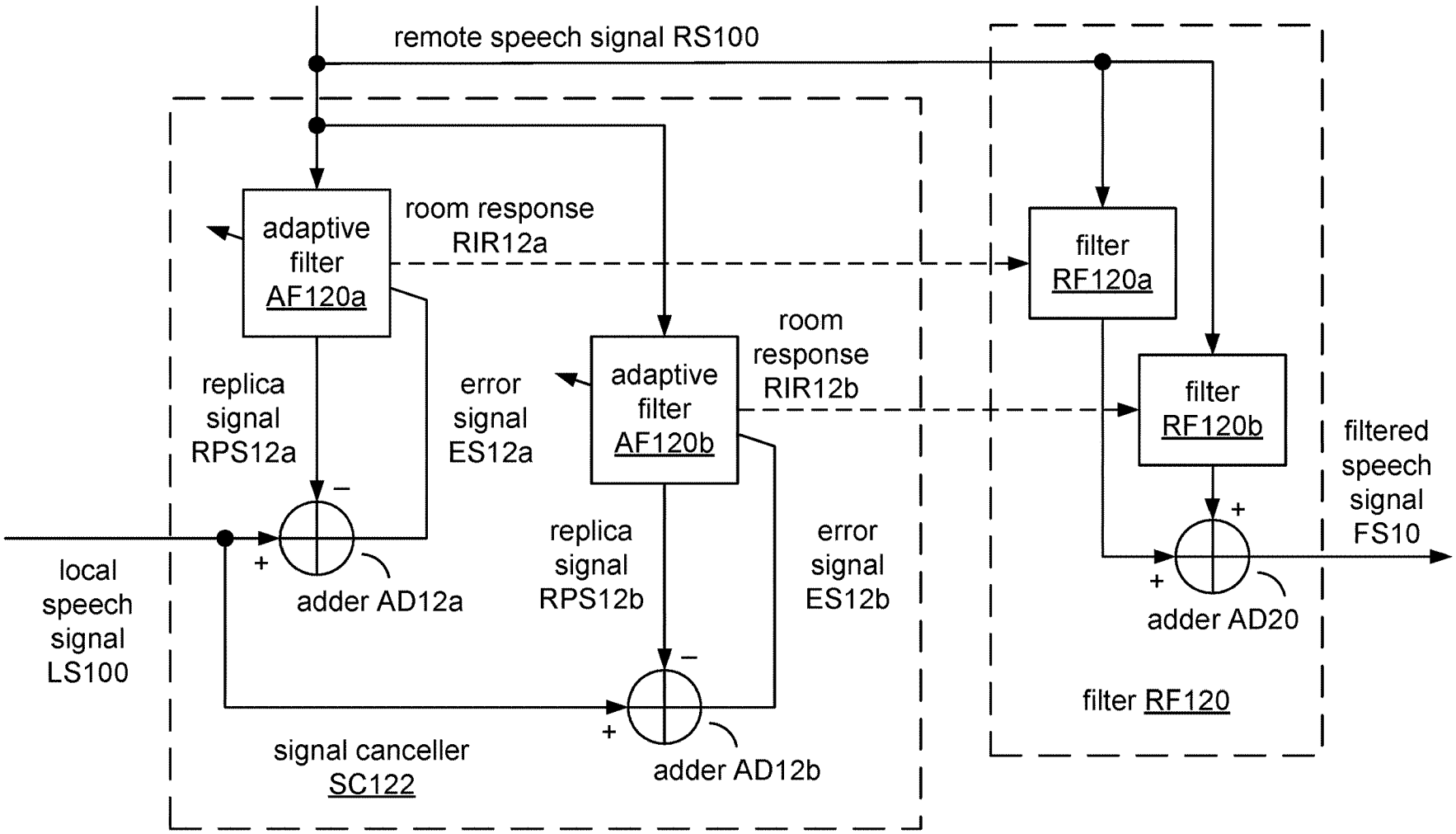
FIG. 6 shows a block diagram of an implementation SC122 of signal cancellers SC100 and SC102 and an implementation RF120 of filter RF100.

As mentioned above, adaptive filter AF100 may be implemented to include multiple filter structures. In such case, the various filter structures may differ in terms of tap length, adaptation rate, filter structure type, frequency band, etc. FIG. 5 shows corresponding implementations SC112 of signal canceller SC100 and RF110 of filter RF110. In one example, the structures shown in FIG. 5 are implemented such that the adaptation rate for adaptive filter AF110*b* (on error signal ES10*a*) is higher than the adaptation rate for adaptive filter AF110*a* (on local speech signal LS100). FIG. 6 shows corresponding implementations SC122 of signal canceller SC100 and RF120 of filter RF100. In one example, the structures shown in FIG. 6 are implemented such that the tap length of adaptive filter AF120*b* (e.g., to model reverberant paths) is higher than the tap length of adaptive filter AF120*a* (e.g., to model the direct path).

It is contemplated that the user would wear an implementation of device D100 on each ear, with each device applying a room response that is based on a signal from a corresponding instance of microphone MC100 at that ear. In such case, the two devices may operate independently. Alternatively, one of the devices may be configured to receive wireless signal WS10 and to retransmit it to the other device (e.g., over a different frequency and/or modality). In one such example, a device at one ear receives wireless signal WS10 as a Bluetooth® signal and re-transmits it to the other device using NFMI. Communications between devices at different ears may also carry control signals (e.g., volume control, sleep/wake) and may be one-way or bidirectional.

A user of device D100 may still want to have some sensation of the atmosphere or ambiance of the surrounding audio environment. In such case, it may be desirable to mix some of the ambient signal into the louder volume voice.

Figure 7:
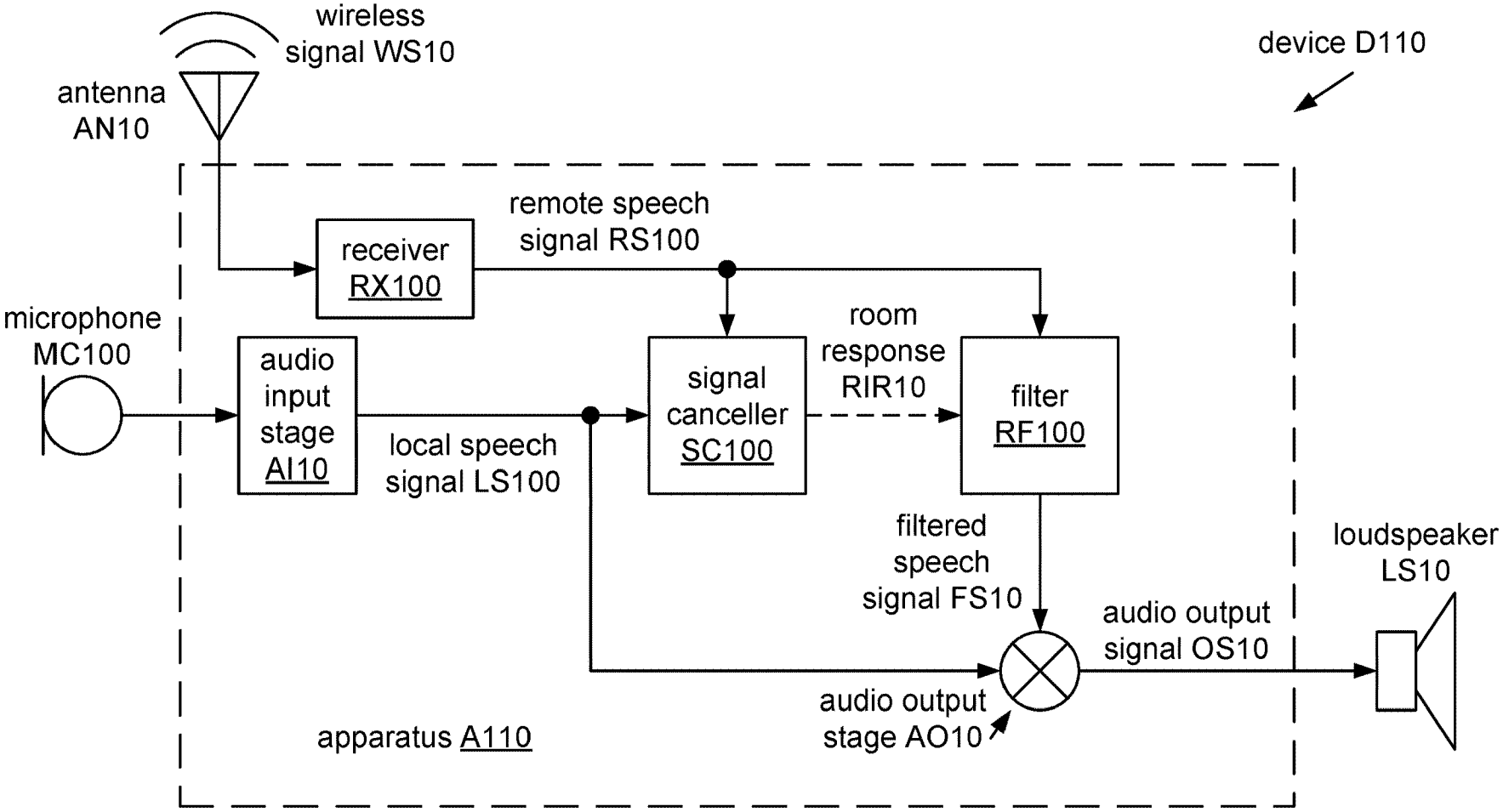
FIG. 7 shows a block diagram of an implementation D110 of device D100 that includes an implementation A110 of apparatus A100.

FIG. 7 shows a block diagram of an implementation D110 of device D100 that includes such an implementation A110 of apparatus A100. Apparatus A110 includes an audio output stage AO10 that is configured to produce an audio output signal OS10 that is based on local speech signal LS100 and filtered speech signal FS10. Audio output stage AO10 may be configured to combine (e.g., to mix) local speech signal LS100 and filtered speech signal FS10 to produce audio output signal OS10. Audio output stage AO10 may also be configured to perform any other desired audio processing operation on local speech signal LS100 and/or filtered speech signal FS10 (e.g., filtering, amplifying, applying a gain factor to, and/or controlling a level of such a signal) to produce audio output signal OS10. In device D110, loudspeaker LS10 is arranged to reproduce audio output signal OS10. In a further implementation, audio output stage AO10 may be configured to select a mixing level automatically based on (e.g., in proportion to) signal-to-noise ratio (SNR) of, e.g., local speech signal LS100.

FIG. 8 shows a picture of an implementation D10R of device D100 or D110 as a hearable configured to be worn at a right ear of a user. Such a device D10R may include any among a hook or wing to secure the device in the cymba and/or pinna of the ear; an ear tip to provide passive acoustic isolation; one or more switches and/or touch sensors for user control; one or more additional microphones (e.g., to sense an acoustic error signal); and one or more proximity sensors (e.g., to detect that the device is being worn).

In a situation where a conversation among two or more people is competing with ambient noise, it may be desirable to increase the volume of the conversation and decrease the volume of the noise while still maintaining the natural spatial sensation of the various sound objects. Typical use cases in which such a situation may arise include a loud bar or cafeteria, which may be too loud to allow nearby friends to carry on a normal conversation (e.g., as illustrated in FIG. 10).

Figure 9:
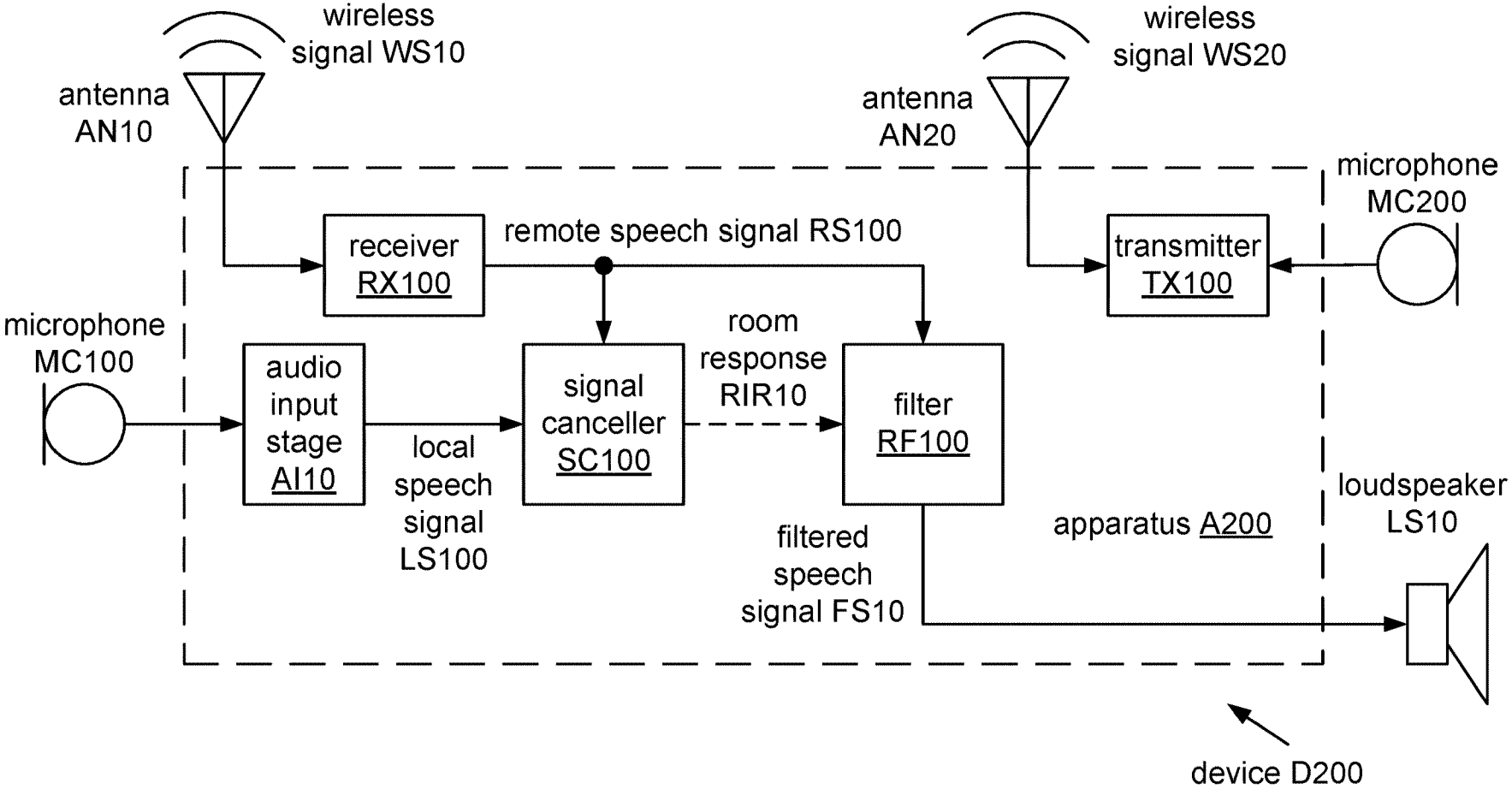
FIG. 9 shows a block diagram of an implementation D200 of device D100 that includes an implementation A200 of apparatus A100.
Figure 11:
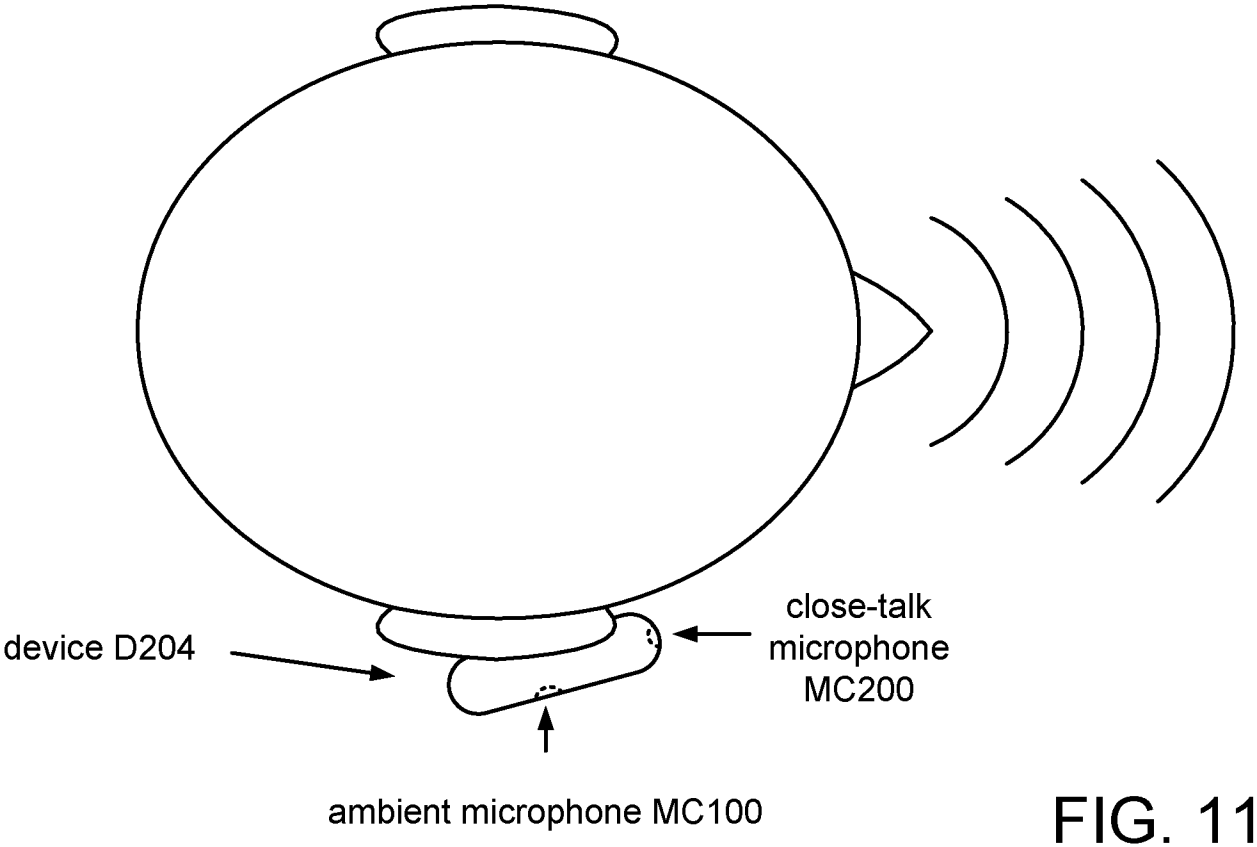
FIG. 11 shows a diagram of an implementation D204 of device D200 in use.

It may be desirable to provide a close-talk microphone and transmitter for each user to supply a signal to be received by the other user(s) as wireless signal WS10 and applied as remote speech signal RS100 (e.g., the reference signal). FIG. 9 shows a block diagram of an implementation D200 of device D100 that includes an implementation A200 of apparatus A100 which includes a transmitter TX100. Transmitter TX100 is configured to produce a wireless signal WS20 that is based on a signal produced by a microphone MC200. FIG. 10 shows an example of instances D202-1 and D202-2 of device D200 in use, and FIG. 11 shows an example of an implementation D204 of device D200 in use. Examples of microphones that may be implemented as microphone MC200 include a lapel microphone, a pendant microphone, and a boom or mini-boom microphone worn on the speaker's head (e.g., on the speaker's ear). Other examples include a bone conduction microphone (e.g., located at the user's right mastoid, collarbone, chin angle, forehead, vertex, inion, between the forehead and vertex, or just above the temple) and an error microphone (e.g., located at the opening to or within the user's ear canal). Alternatively, apparatus A200 may be implemented to perform voice and background separation processing (e.g., beamforming, beamforming/nullforming, blind source separation) on signals from a microphone of the device at the left ear (e.g., the corresponding instance of MC100) and a microphone of the device at the right ear (e.g., the corresponding instance of MC100) to produce voice and background outputs, with the voice output being used as input to transmitter TX100.

Figure 12:
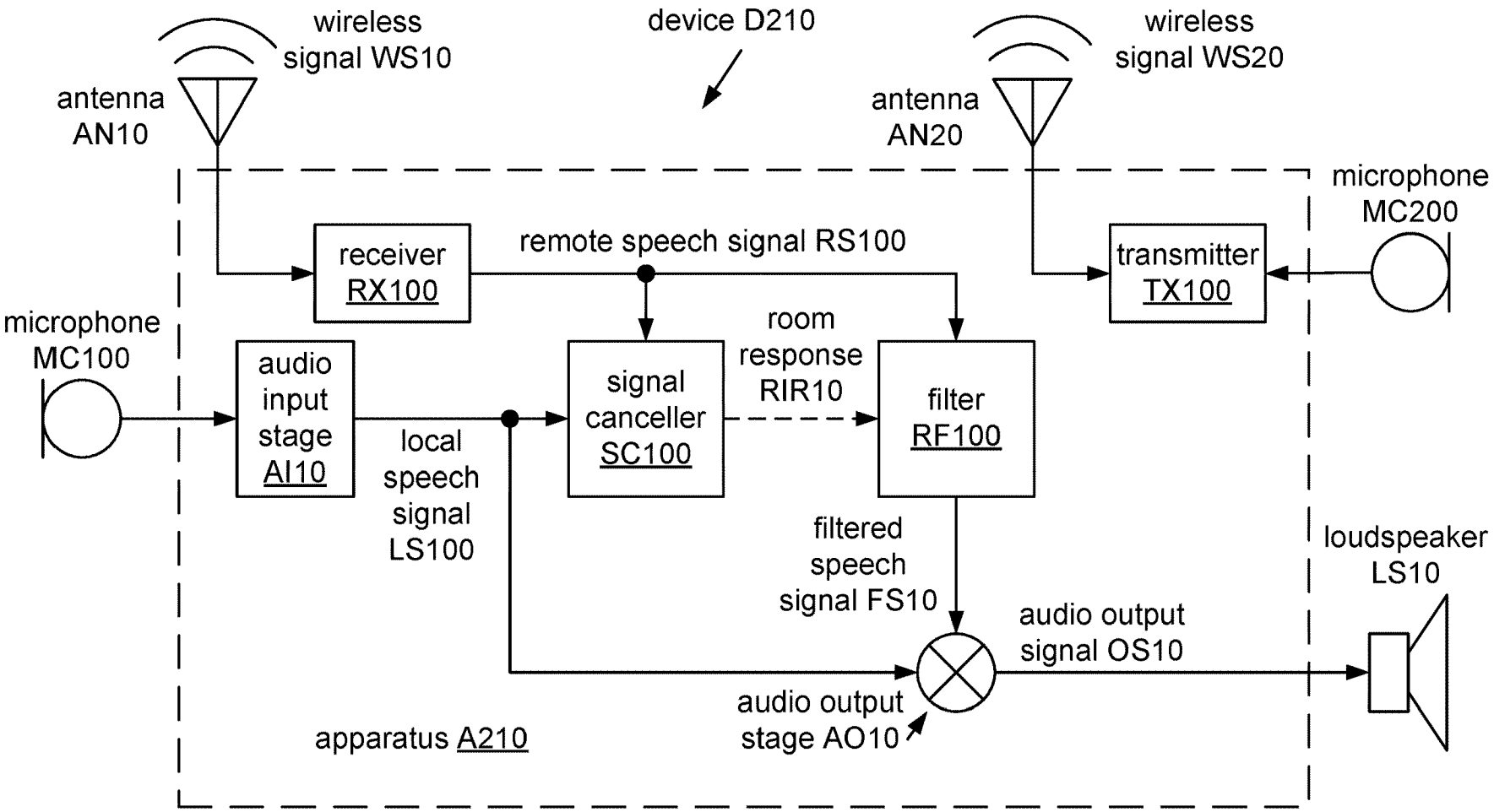
FIG. 12 shows a block diagram of an implementation D210 of devices D110 and D200 that includes an implementation A210 of apparatus A110 and A200.

Device D200 may be implemented to include two antennas AN10, AN20 as shown in FIG. 9, or a single antenna with a duplexer (not shown) for reception of wireless signal WS10 and transmission of wireless signal WS20. Wireless protocols that may be used to carry wireless signal WS20 include (without limitation) any of those mentioned above with reference to wireless signal WS10 (including any of the magnetic induction and light-wave carrier examples). FIG. 12 shows a block diagram of an implementation D210 of device D110 and D200 that includes an implementation A210 of apparatus A110 and A200.

Figure 13:
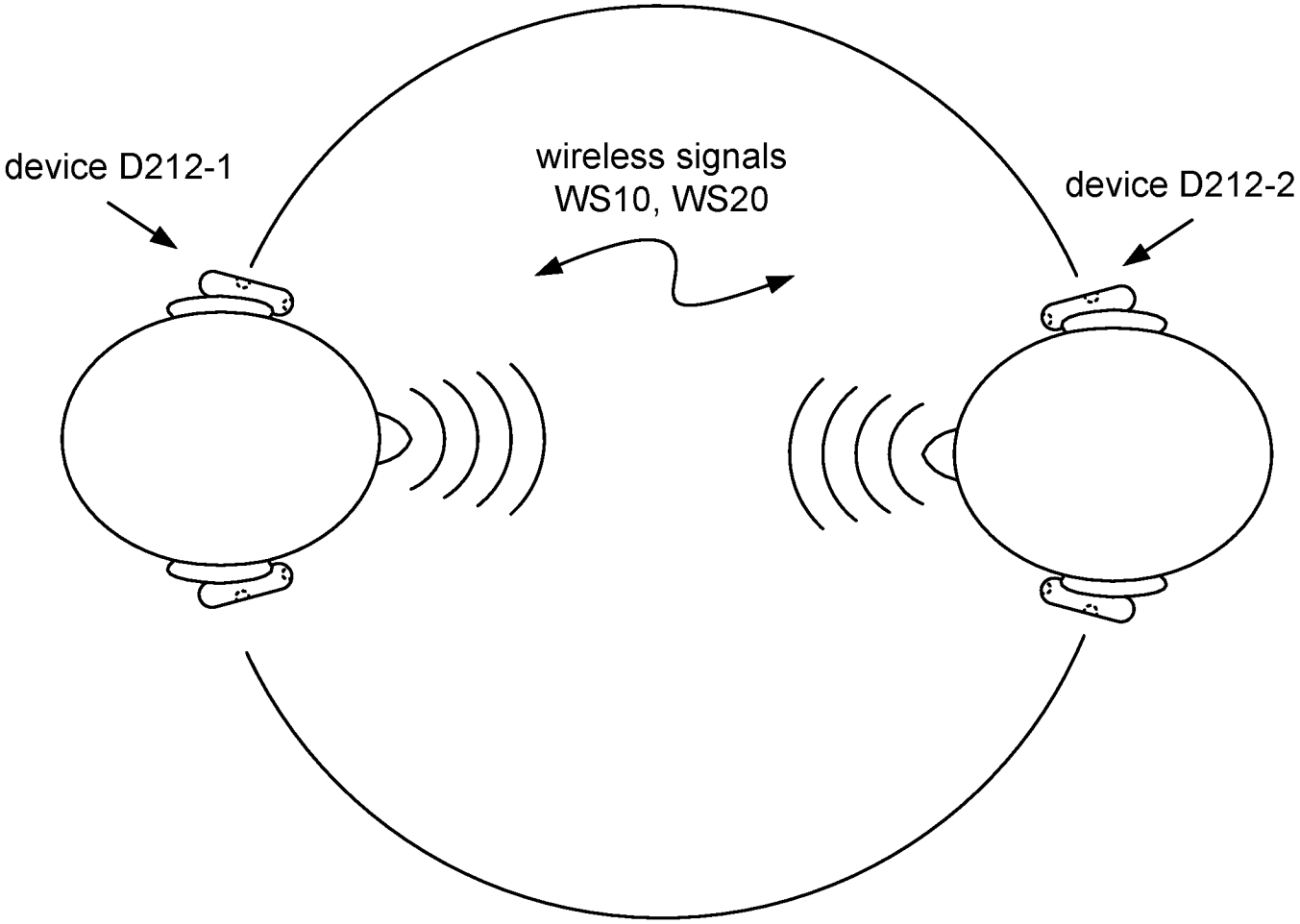
FIG. 13 shows an example of implementations D212-1, D212-2 of device D210 in use.
Figure 14:
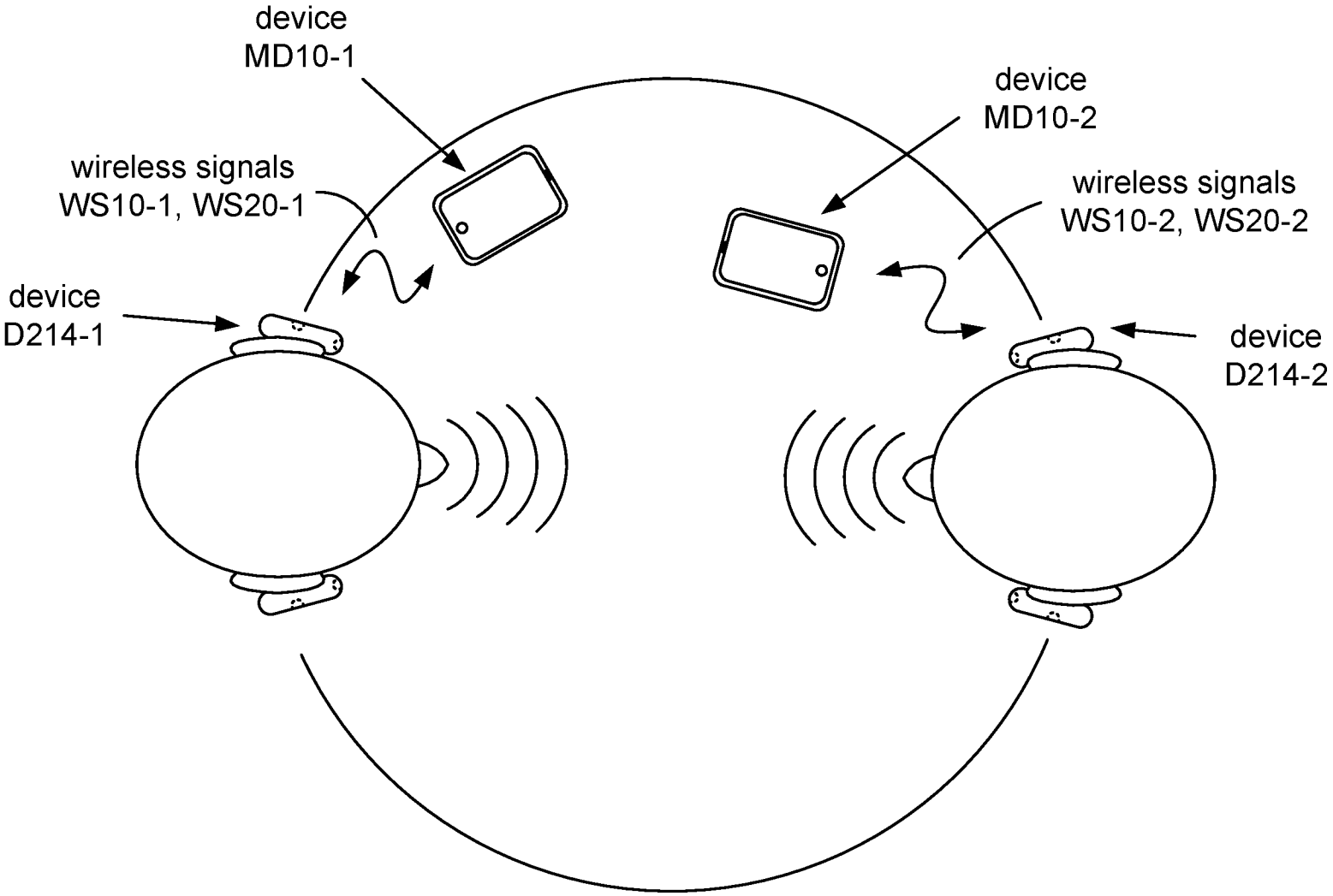
FIG. 14 shows an example of implementations D214-1, D214-2 of device D210 in use.

Instances of device D200 as worn by each user may be configured to exchange wireless signals WS10, WS20 directly. FIG. 13 depicts such a use case between implementations D212-1, D212-2 of device D200 (or D210). Alternatively, device D200 may be implemented to exchange wireless signals WS10, WS20 with an intermediate device, which may then communicate with another instance of device D200 either directly or via another intermediate device. FIG. 14 shows an example in which one user's implementation D214-1 of device D200 (or D210) exchanges its wireless signals WS10, WS20 with a mobile device (e.g., smartphone or tablet) MD10-1, and another user's implementation D214-2 of device D200 (or D210) exchanges its wireless signals WS10, WS20 with a mobile device MD10-2. In such case, the mobile devices communicate with each other (e.g., via Bluetooth®, Wi-Fi, infrared, and/or a cellular network) to complete the two-way communications link between devices D214-1 and D214-2.

As noted above, a user may wear corresponding implementations of device D100 (e.g., D110, D200, D210) on each ear. In such case, the two devices may perform enhancement of the same acoustic signal carried by wireless signal WS10, with each device performing signal cancellation on a respective instance of local speech signal LS100. Alternatively, the two instances of local speech signal LS100 may be processed by a common apparatus that produces a corresponding instance of filtered speech signal FS10 for each ear.

Figure 15A:
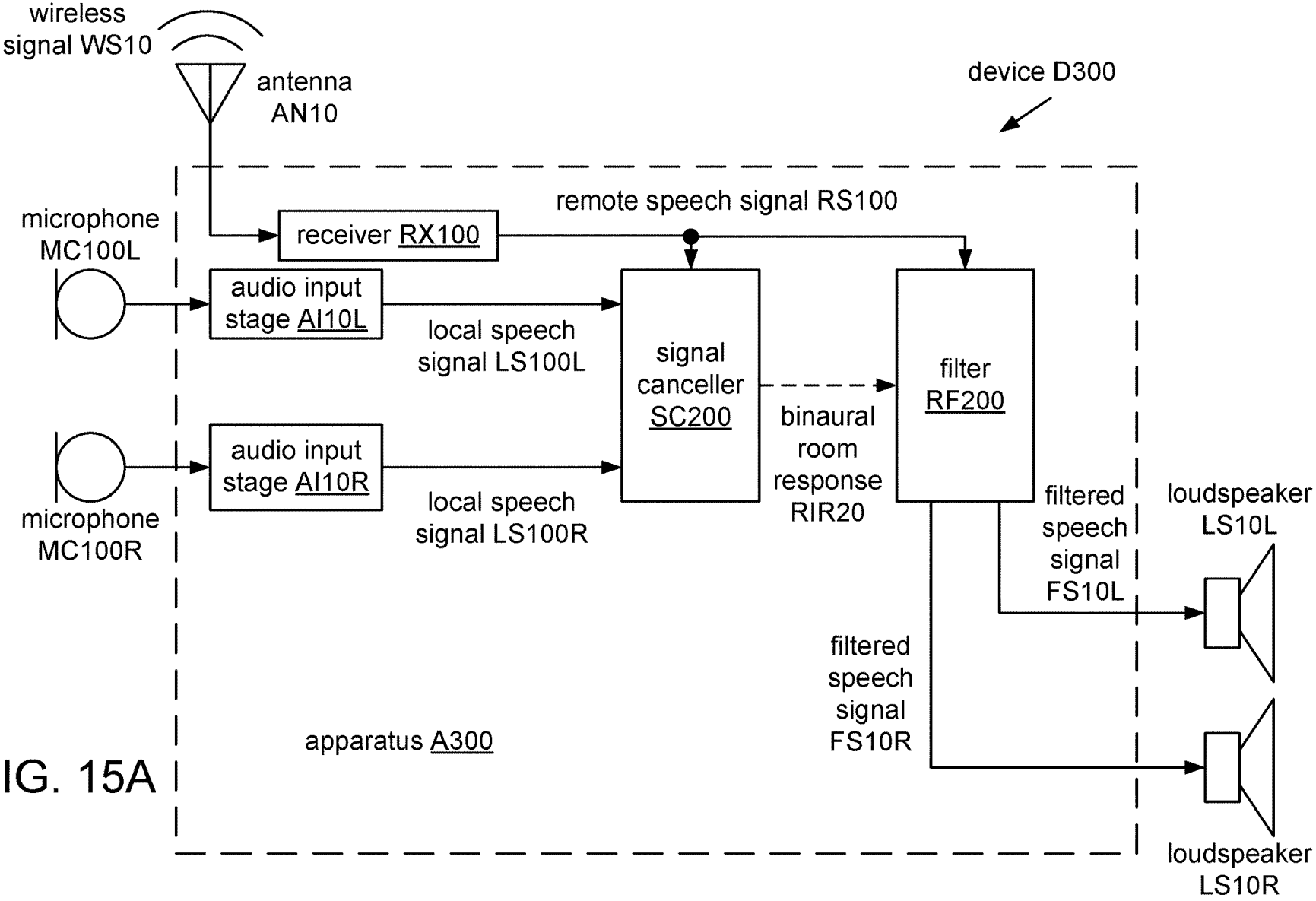
FIG. 15A shows a block diagram of a device D300 that includes an implementation A300 of apparatus A100.
Figure 15B:
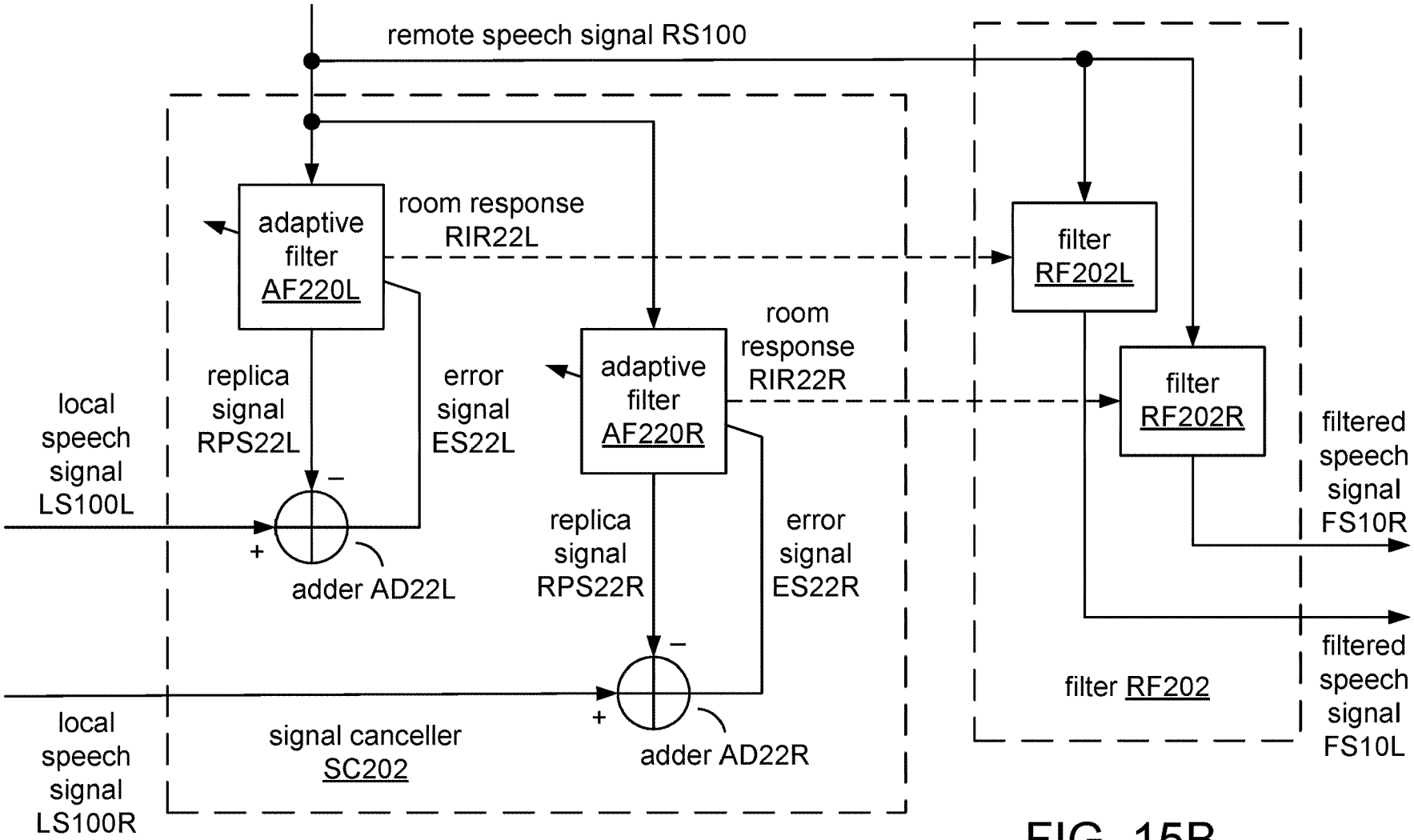
FIG. 15B shows a block diagram of an implementation SC202 of signal canceller SC200 and an implementation RF200 of filter RF200.
Figure 16:
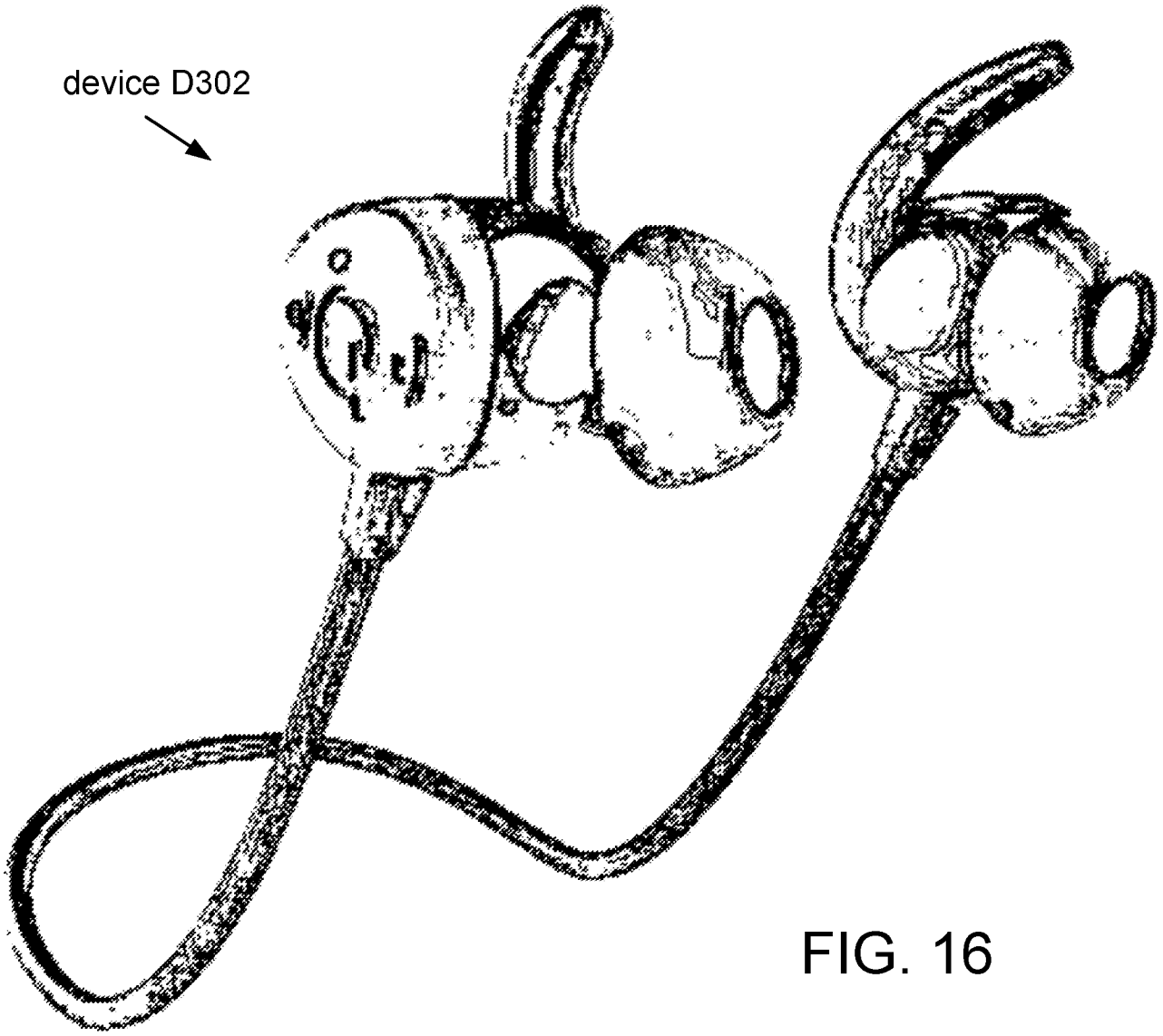
FIG. 16 shows a picture of one example of an implementation D302 of device D300.

FIG. 15A shows a block diagram of a device D300 that includes an implementation A300 of apparatus A100. Apparatus A300 includes an implementation SC200 of signal canceller SC100 that performs an signal cancellation operation on left and right instances LS100L and LS100R of local speech signal LS100 to produce a binaural room response (e.g., a binaural room impulse response or 'BRIR') RIR20. An implementation RF200 of filter RF100 filters the remote speech signal RS100 to produce corresponding left and right instances FS10L, FS10R of filtered speech signal FS10, one for each ear. FIG. 16 shows a picture of an implementation D302 of device D300 as a hearable configured to be worn at both ears of a user that includes a corresponding instance of microphone MC100 (MC100L, MC100R) and loudspeaker LS10 (LS10L, LS10R) at each ear (e.g., as shown in FIG. 8). It is noted that apparatus A300 and device D300 may also be implemented to be implementations of apparatus A200 and device D200, respectively. FIG. 15B shows a block diagram of an implementation SC202 of signal canceller SC200 and an implementation RF202 of filter RF200. Signal canceller SC202 includes respective instances AF220L, AF220R of adaptive filter AF100 that are each configured to filter remote speech signal RS100 to produce a respective instance RPS22L, RPS22R of replica signal RPS10. Signal canceller SC202 also includes respective instances AD22L, AD22R of adder AD10 that are each configured to subtract the respective replica signal RPS22L, RPS22R from the respective one of local speech signal LS100L and third audio input signal IS200R to produce a respective instance ES22L, ES22R of error signal ES10. In this example, adaptive filter AF220L is configured to update the values of its filter coefficients (room response RIR22L) based on error signal ES22L, and adaptive filter AF220R is configured to update the values of its filter coefficients (room response RIR22R) based on error signal ES22R. The room responses RIR22L and RIR22R together comprise an instance of binaural room response RIR20. Filter RF202 includes respective instances RF202*a*, RF202*b* of filter RF100 that are each configured to apply the corresponding room response RIR22L, RIR22R to remote speech signal RS100 to produce the corresponding instance FS10L, FS10R of filtered speech signal FS10.

FIG. 17 shows a block diagram of an implementation of device D300 as two separate devices D350*a*, D350*b* that communicate wirelessly (e.g., according to any of the modalities noted herein). Device D350*b* includes a transmitter TX150 that transmits local speech signal LS100R to receiver RX150 of device D350*a*, and device D350*a* includes a transmitter TX250 that transmits filtered speech signal FS10R to receiver RX250 of device D350*b*. Such communication among devices D350*a* and D350*b* may be performed using any of the modalities noted herein (e.g., Bluetooth®, NFMI), and transmitter TX150 and/or receiver RX150 may include circuitry analogous to audio input stage AI10. In this particular and non-limiting example, devices D350*a* and D350*b* are configured to be worn at the right ear and the left ear of the user, respectively. It is noted that apparatus A350 and device D350*a* may also be implemented to be implementations of apparatus A200 and device D200, respectively.

Figure 18:
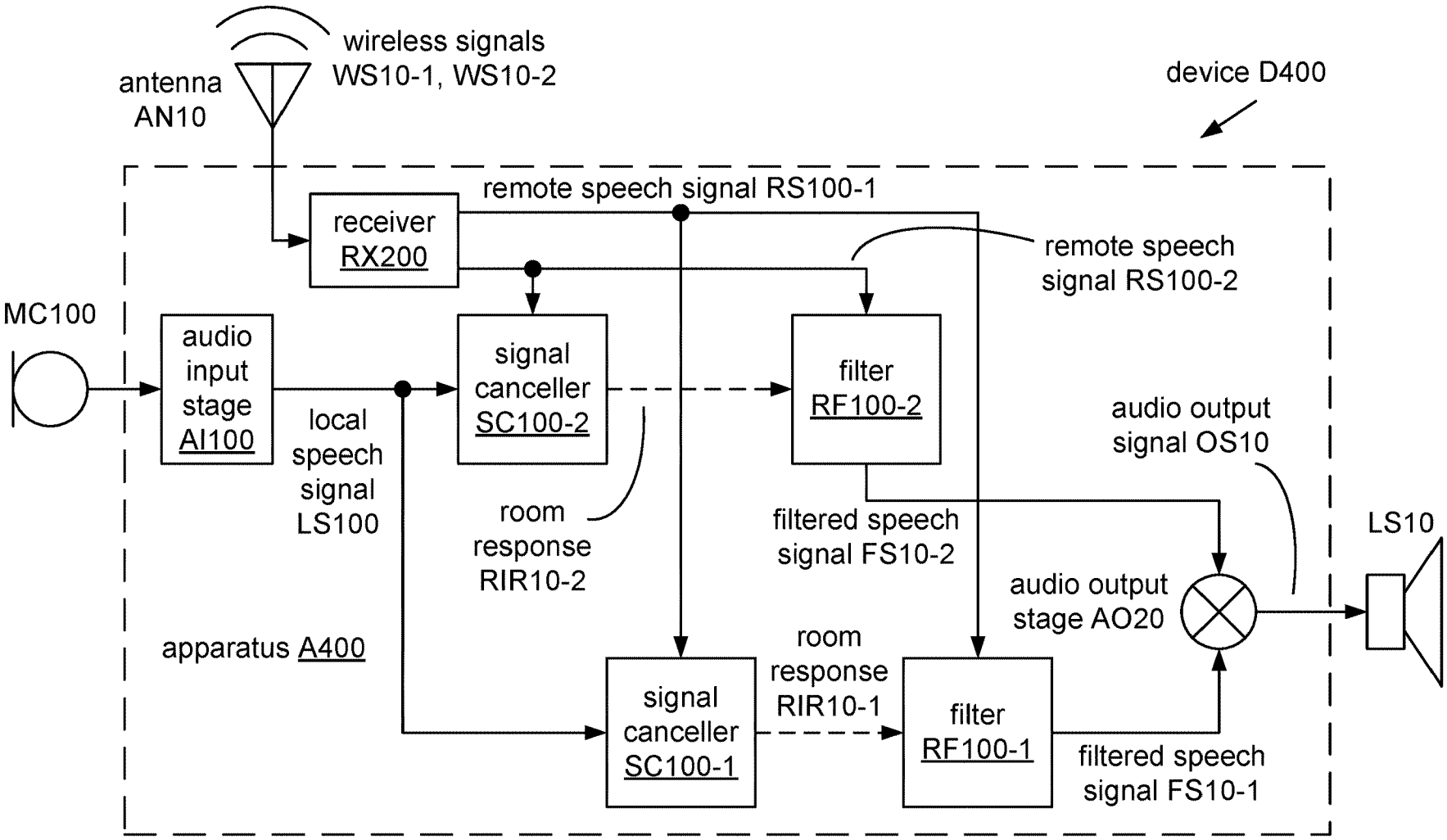
FIG. 18 shows a block diagram of a device D400 that includes an implementation A400 of apparatus A100 and A110.

It may be desirable to apply principles as disclosed herein to enhance acoustic signals received from multiple sources (e.g., from each of two or more speakers). FIG. 18 shows a block diagram of such an implementation D400 of device D100 that includes an implementation A400 of apparatus A100. Apparatus A400 includes an implementation RX200 of receiver RX100 that receives multiple instances WS10-1, WS10-2 of wireless signal WS10 to produce multiple corresponding instances RS100-1, RS100-2 of remote speech signal RS100 (e.g., each from a different speaker). For each of these instances, apparatus A400 uses a respective instance SC100-1, SC100-2 of signal canceller SC100 to perform a respective signal cancellation operation on local speech signal LS100, using the respective instance RS100-1, RS100-2 of remote speech signal RS100 as a reference signal, to generate a respective instance RIR10-1, RIR10-2 of room response RIR10 (e.g., to model the respective acoustic path from the speaker to microphone MC100). Apparatus A400 uses respective instances RF100-1, RF100-2 of filter RF100 to filter the corresponding instance RS100-1, RS100-2 of remote speech signal RS100 according to the corresponding instance RIR10-1, RIR10-2 of room response RIR10 to produce a corresponding instance FS10-1, FS10-2 of filtered speech signal FS10, and an implementation AO20 of audio output stage AO10 combines (e.g., mixes) the filtered speech signals to produce audio output signal OS10.

It is noted that the implementation of apparatus A400 as shown in FIG. 18 may be arbitrarily extended to accommodate three or more sources (i.e., instances of remote speech signal RS100). In any case, it may be desirable to configure the respective instances of signal canceller SC100 to update their respective models (e.g., to adapt their filter coefficient values) only when the other instances of remote speech signal RS100 are inactive.

Figure 19:
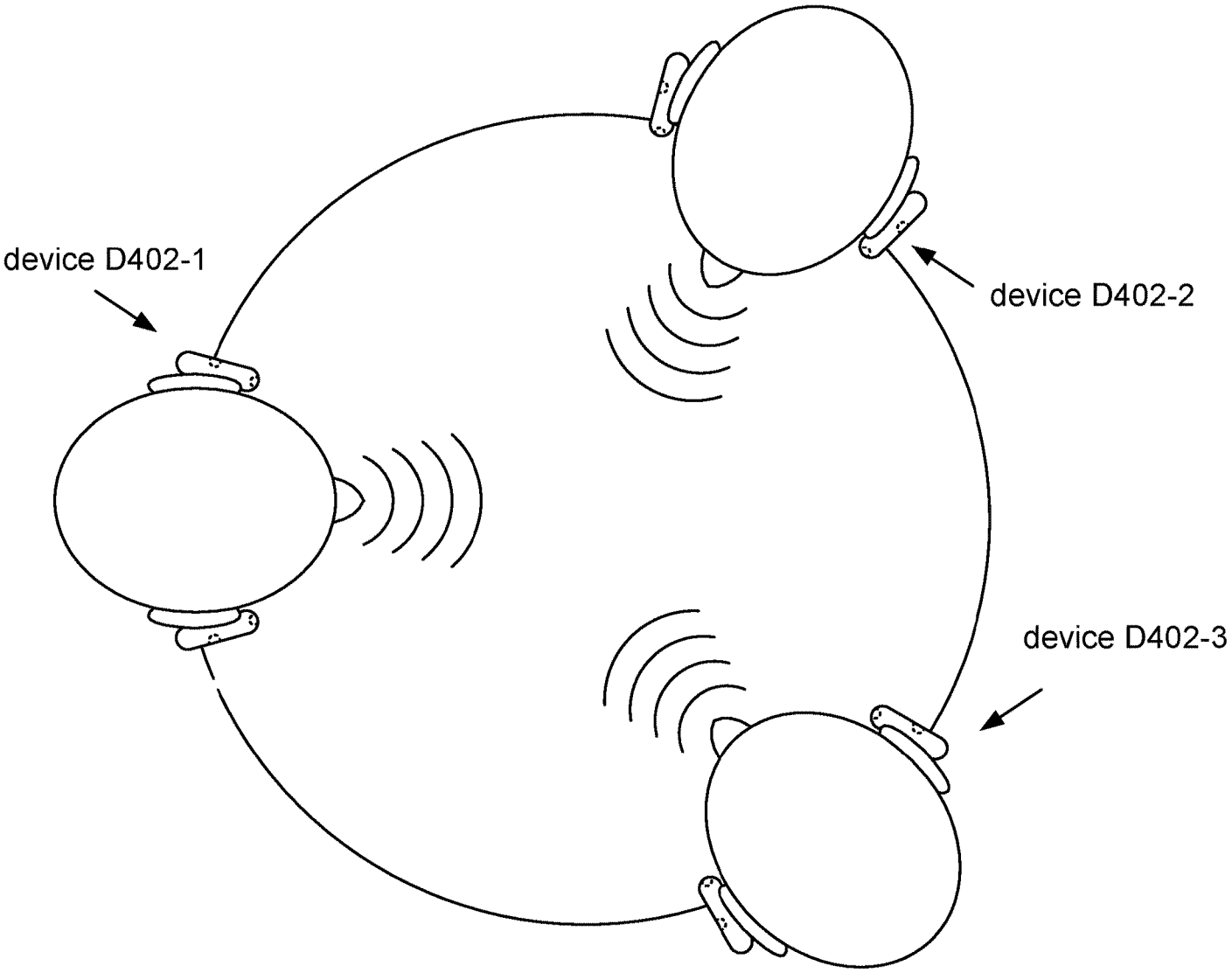
FIG. 19 shows an example of implementations D402-1, D402-2, D402-3 of device D400 in use.

It is noted that apparatus A400 and device D400 may also be implemented to be implementations of apparatus A200 and device D200, respectively (i.e., each including respective instances of microphone MC200 and transmitter TX100). FIG. 19 shows an example of communications among three such implementations D402-1, D402-2, D402-3 of device D400. Additionally or alternatively, apparatus A400 and device D400 may also be implemented to be implementations of apparatus A300 and device D300, respectively. Additionally or alternatively, apparatus A400 and device D400 may also be implemented to be implementations of apparatus A110 and device D110, respectively (e.g., to mix a desired amount of local speech signal LS100 into audio output signal OS10).

Figure 20C:
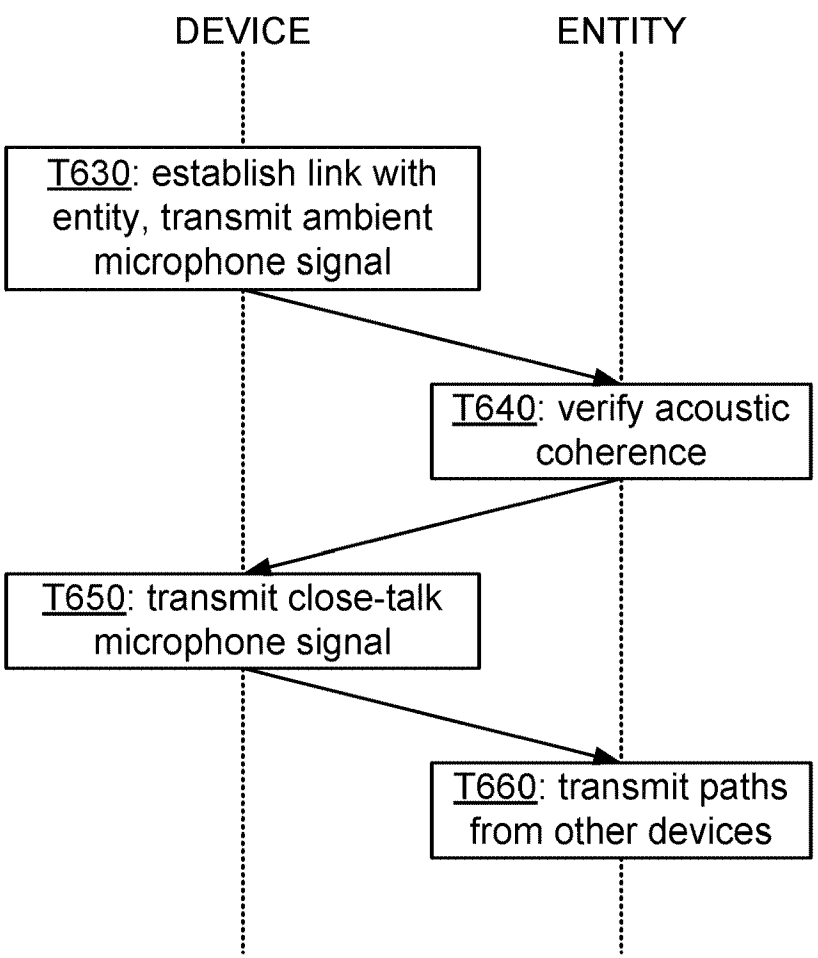
FIGS. 20A, 20B, and 20C show examples of an enrollment process and two handshaking processes, respectively.
Figure 20B:
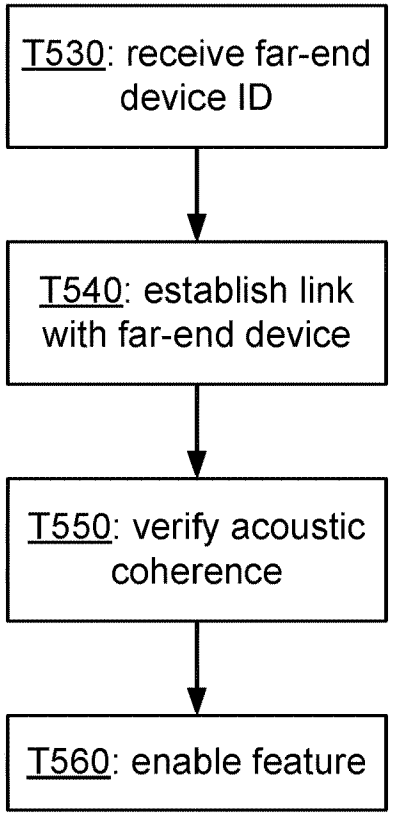
Figure 20A:
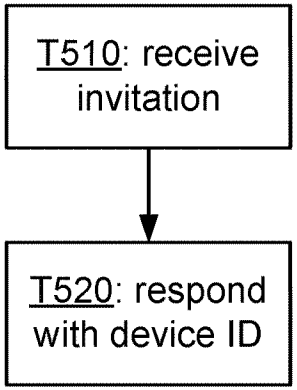

Pairing among devices D200 (e.g., D400) of different users may be performed according to an automated agreement. FIG. 20A shows a flowchart of an example of an enrollment process in which a user sends meeting invitations to the other users, which may be received (task T510) and accepted with a response that includes the device ID of the receiving user's instance of device D200 (task T520). The device IDs may then be distributed among the invitees. FIG. 20B shows a flowchart of an example of a subsequent handshaking process in which each device receives the device ID of another device (task T530). At the designated meeting time, the designated devices may begin to periodically attempt to connect to each other (task T540). A device may calculate acoustic coherence between itself and each other device (e.g., a measure of correlation of the ambient microphone signals) to make sure that the other device is at the same location (e.g., at the same table) (task T550). If acoustic coherence is verified, the device may enable the feature as described herein (e.g., by exchanging wireless signals WS10, WS20 with the other device) (task T560).

An alternative implementation of the handshaking process may be performed by a central entity (e.g., a server, or a master among the devices). FIG. 20C shows a flowchart of an example of such a process in which the device connects to the entity and transmits information based on a signal from its ambient microphone (task T630). The entity processes this information from the devices to verify acoustic coherence among them (task T640). A check may also be performed to verify that each device is being worn (e.g., by checking a proximity sensor of each device, or by checking acoustic coherence again). If these criteria are met by a device, it is linked to the other participants.

Such a handshaking process may be extended to include performance of the signal cancellation process by the central entity. In such case, for example, each verified device continues to transmit information based on a signal from its ambient microphone to the entity, and also transmits information to the entity that is based on a signal from its close-talk microphone (task T650). Paths between the various pairs of devices are calculated and updated by the entity and transmitted to the corresponding devices (e.g., as sets of filter coefficient values for filter RF100) (task T660).

Figure 21B:
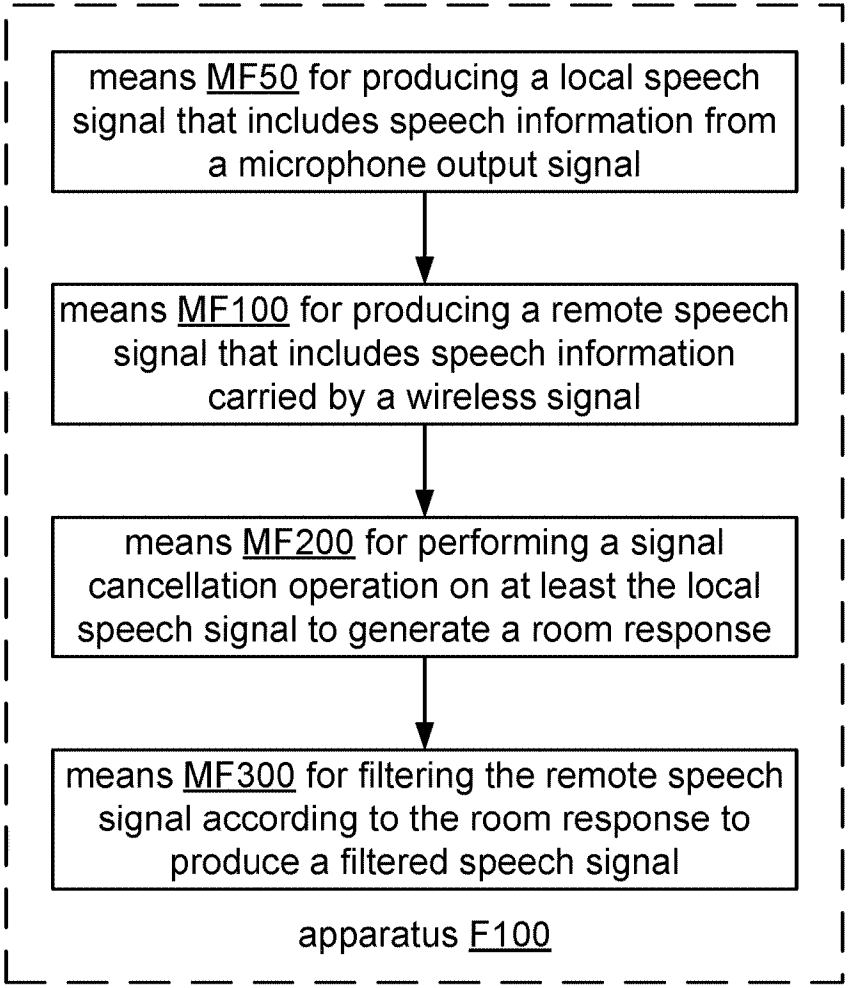
FIG. 21B shows a block diagram of an apparatus F100 according to a general configuration.
Figure 21A:
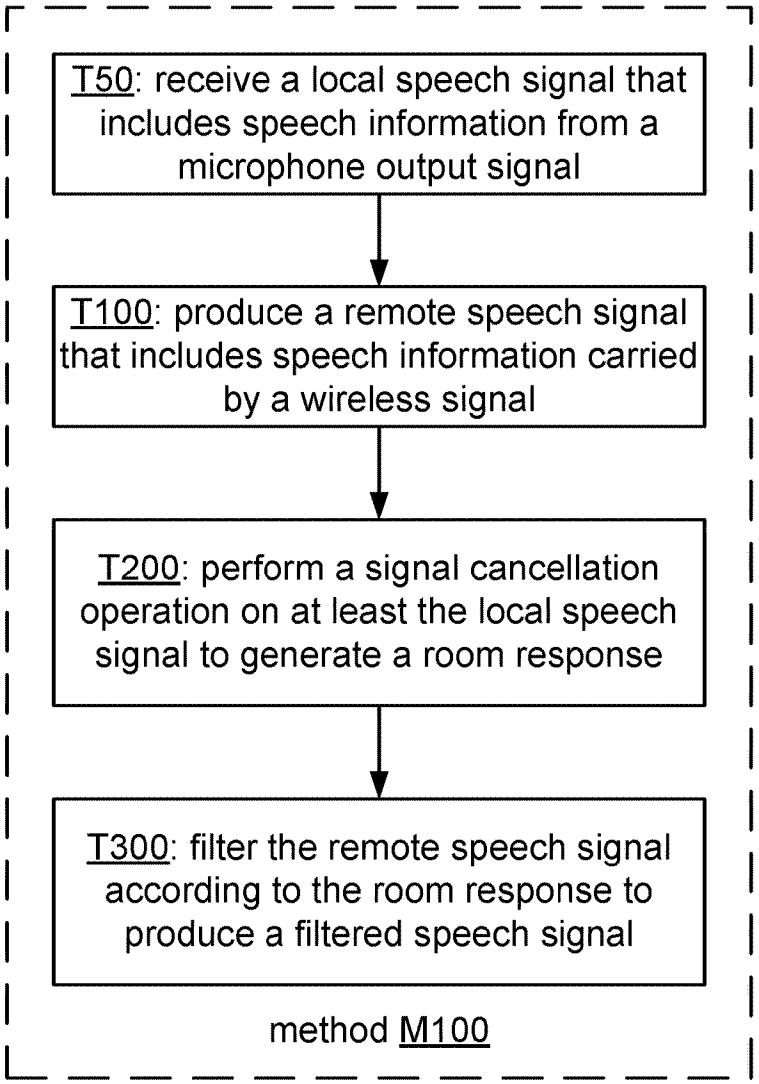
FIG. 21A shows a flowchart of a method of signal enhancement M100 according to a general configuration.

FIG. 21A shows a flowchart of a method M100 according to a general configuration that includes tasks T100, T200, and T300. Task T50 receives a local speech signal that includes speech information from a microphone output signal (e.g., as described herein with reference to audio input stage AI10). Task T100 produces a remote speech signal that includes speech information carried by a wireless signal (e.g., as described herein with reference to receiver RX100). Task T200 performs a signal cancellation operation, which is based on the remote speech signal as a reference signal, on at least the local speech signal to generate a room response (e.g., as described herein with reference to signal canceller SC100). Task T300 filters the remote speech signal according to the room response to produce a filtered speech signal (e.g., as described herein with reference to filter RF100).

FIG. 21B shows a block diagram of an apparatus F100 according to a general configuration that includes means MF50 for producing a local speech signal that includes speech information from a microphone output signal (e.g., as described herein with reference to audio input stage AI10), means MF100 for producing a remote speech signal that includes speech information carried by a wireless signal (e.g., as described herein with reference to receiver RX100), means MF200 for performing a signal cancellation operation, which is based on the remote speech signal as a reference signal, on at least the local speech signal to generate a room response (e.g., as described herein with reference to signal canceller SC100), and means MF300 for filtering the remote speech signal according to the room response to produce a filtered speech signal (e.g., as described herein with reference to filter RF100). Apparatus F100 may be implemented to include means for transmitting, via magnetic induction, a signal based on the speech information carried by the wireless signal (e.g., as described herein with reference to transmitter TX150 and/or TX250) and/or means for combining the filtered speech signal with a signal that is based on the local speech signal to produce an audio output signal (e.g., as described herein with reference to audio output stage AO10). Alternatively or additionally, apparatus F100 may be implemented to include means for producing a second remote speech signal that includes speech information carried by a second wireless signal; means for performing a second signal cancellation operation, which is based on the second remote speech signal as a reference signal, on at least the local speech signal to generate a second room response; and means for filtering the remote speech signal according to the second room response to produce a second filtered speech signal (e.g., as described herein with reference to apparatus A400). Alternatively or additionally, apparatus F100 may be implemented such that means MF200 includes means for filtering the first audio input signal to produce a replica signal and means for subtracting the replica signal from the local speech signal (e.g., as described herein with reference to signal canceller SC102); and/or such that means MF200 is configured to perform the signal cancellation operation on the local speech signal and on a second local speech signal to generate the room response as a binaural room response and means MF300 is configured to filter the remote speech signal according to the binaural room response to produce a left-side filtered speech signal and a right-side filtered speech signal that is different than the left-side filtered speech signal (e.g., as described herein with reference to apparatus A300).

The various elements of an implementation of an apparatus or system as disclosed herein (e.g., apparatus A100, A110, A200, A210, A300, A350, A400, or F100; device D100, D110, D200, D210, D300, D350*a*, or D400) may be embodied in any combination of hardware with software and/or with firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs (digital signal processors), FPGAs (field-programmable gate arrays), ASSPs (application-specific standard products), and ASICs (application-specific integrated circuits). A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a procedure of an implementation of method M100 (or another method as disclosed with reference to operation of an apparatus or system described herein), such as a task relating to another operation of a device or system in which the processor is embedded (e.g., a voice communications device, such as a smartphone, or a smart speaker). It is also possible for part of a method as disclosed herein to be performed under the control of one or more other processors.

Each of the tasks of the methods disclosed herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

In one example, a non-transitory computer-readable storage medium comprises code which, when executed by at least one processor, causes the at least one processor to perform a method of signal enhancement as described herein (e.g., with reference to method M100). Further examples of such a storage medium include a medium comprising code which, when executed by the at least one processor, causes the at least one processor to receive a local speech signal that includes speech information from a microphone output signal (e.g., as described herein with reference to audio input stage AI10), to produce a remote speech signal that includes speech information carried by a wireless signal (e.g., as described herein with reference to receiver RX100), to perform a signal cancellation operation, which is based on the remote speech signal as a reference signal, on at least the local speech signal to generate a room response (e.g., as described herein with reference to signal canceller SC100), and to filter the remote speech signal according to the room response to produce a filtered speech signal (e.g., as described herein with reference to filter RF100).

Such a storage medium may further comprise code which, when executed by the at least one processor, causes the at least one processor to cause transmission, via magnetic induction, of a signal based on the speech information carried by the wireless signal (e.g., as described herein with reference to transmitter TX150 and/or TX250) and/or to combine the filtered speech signal with a signal that is based on the local speech signal to produce an audio output signal (e.g., as described herein with reference to audio output stage AO10). Alternatively or additionally, such a storage medium may further comprise code which, when executed by the at least one processor, causes the at least one processor to produce a second remote speech signal that includes speech information carried by a second wireless signal; to perform a second signal cancellation operation, which is based on the second remote speech signal as a reference signal, on at least the local speech signal to generate a second room response; and to filter the remote speech signal according to the second room response to produce a second filtered speech signal (e.g., as described herein with reference to apparatus A400). Alternatively or additionally, such a storage medium may be implemented such that the code to perform a signal cancellation operation includes code which, when executed by the at least one processor, causes the at least one processor to filter the first audio input signal to produce a replica signal and to subtract the replica signal from the local speech signal (e.g., as described herein with reference to signal canceller SC102); and/or such that the code to perform a signal cancellation operation includes code which, when executed by the at least one processor, causes the at least one processor to perform the signal cancellation operation on the local speech signal and on a second local speech signal to generate the room response as a binaural room response and the code to filter the remote speech signal according to the room response to produce a filtered speech signal includes code which, when executed by the at least one processor, causes the at least one processor to filter the remote speech signal according to the binaural room response to produce a left-side filtered speech signal and a right-side filtered speech signal that is different than the left-side filtered speech signal (e.g., as described herein with reference to apparatus A300).

The previous description is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. An apparatus for signal enhancement, the apparatus comprising:

a memory configured to store a first local speech signal that includes speech information from a first microphone output signal and a second local speech signal that includes speech information from a second microphone output signal; and a processor configured to:

receive the first local speech signal and the second local speech signal;

produce a remote speech signal that includes speech information carried by a wireless signal;

perform a signal cancellation operation, which is based on the remote speech signal as a reference signal, on at least the first local speech signal and the second local speech signal to generate a binaural room response; and filter the remote speech signal according to the binaural room response to produce a filtered speech signal.

2. The apparatus for signal enhancement according to claim 1, wherein the processor configured to perform the signal cancellation operation is configured to:

filter the remote speech signal to produce a first replica signal and a second replica signal;

subtract the first replica signal from the first local speech signal; and subtract the second replica signal from the second local speech signal.

3. The apparatus for signal enhancement according to claim 1, wherein the processor is configured to generate the binaural room response as a set of filter coefficient values.

4. The apparatus for signal enhancement according to claim 1, wherein the processor is further configured to combine the filtered speech signal with a signal that is based on the first local speech signal to produce an audio output signal.

5. A hearable including the apparatus for signal enhancement according to claim 1 and configured to be worn at an ear of a user, the hearable further comprising a first microphone configured to produce the first microphone output signal and a loudspeaker configured to reproduce a signal based on the filtered speech signal.

6. The hearable according to claim 5, wherein the hearable comprises an integrated circuit that includes at least the processor.

7. The hearable according to claim 5, wherein the hearable further comprises:

a second microphone configured to produce the second microphone output signal and arranged to be worn at another ear of the user; and a transmitter configured to transmit a signal based on the second microphone output signal.

8. The hearable according to claim 5, wherein the hearable further comprises a transmitter configured to transmit, via magnetic induction, a signal based on the speech information carried by the wireless signal.

9. A method of signal enhancement, the method comprising:

receiving a first local speech signal that includes speech information from a first microphone output signal;

receiving a second local speech signal that includes speech information from a second microphone output signal;

producing a remote speech signal that includes speech information carried by a wireless signal;

performing a signal cancellation operation, which is based on the remote speech signal as a reference signal, on at least the first local speech signal and the second local speech signal to generate a binaural room response; and filtering the remote speech signal according to the binaural room response to produce a filtered speech signal.

10. The method for signal enhancement according to claim 9, wherein performing the signal cancellation operation comprises:

filtering the remote speech signal to produce a replica signal; and subtracting the replica signal from the first local speech signal.

11. The method for signal enhancement according to claim 9, wherein the binaural room response is a set of filter coefficient values.

12. The method for signal enhancement according to claim 9, the method further comprising combining the filtered speech signal with a signal that is based on the first local speech signal and the second local speech signal to produce an audio output signal.

13. The method for signal enhancement according to claim 9, wherein the method further comprises transmitting, via magnetic induction, a signal based on the speech information carried by the wireless signal.

14. The method for signal enhancement according to claim 9, wherein the speech information included in the first local speech signal, the speech information included in the second local speech signal, and the speech information carried by the wireless signal are from the same acoustic speech signal.

15. The method of signal enhancement according to claim 9, wherein the performing the signal cancellation operation comprises:

filtering the remote speech signal to produce a first replica signal and a second replica signal;

subtracting the first replica signal from the first local speech signal; and subtracting the second replica signal from the second local speech signal.

16. An apparatus for signal enhancement, the apparatus comprising:

means for producing a first local speech signal that includes speech information from a first microphone output signal;

means for producing a second local speech signal that includes speech information from a second microphone output signal;

means for producing a remote speech signal that includes speech information carried by a wireless signal;

means for performing a signal cancellation operation, which is based on the remote speech signal as a reference signal, on at least the first local speech signal and the second local speech signal to generate a binaural room response; and means for filtering the remote speech signal according to the binaural room response to produce a filtered speech signal.

17. The apparatus for signal enhancement according to claim 16, wherein the means for performing the signal cancellation operation comprises means for generating the binaural room response as a set of filter coefficient values.

18. The apparatus for signal enhancement according to claim 16, wherein the means for performing the signal cancellation operation to generate the binaural room response comprises:

means for filtering the remote speech signal to produce a first replica signal and a second replica signal;

means for subtracting the first replica signal from the first local speech signal; and means for subtracting the second replica signal from the second local speech signal.

19. A non-transitory computer-readable storage medium comprising code which, when executed by at least one processor, causes the at least one processor to:

receive a first local speech signal that includes speech information from a first microphone output signal;

receive a second local speech signal that includes speech information from a second microphone output signal;

produce a remote speech signal that includes speech information carried by a wireless signal;

perform a signal cancellation operation, which is based on the remote speech signal as a reference signal, on at least the first local speech signal and the second local speech signal to generate a binaural room response; and filter the remote speech signal according to the binaural room response to produce a filtered speech signal.

20. The non-transitory computer-readable storage medium according to claim 19, wherein causing the at least one processor to perform the signal cancellation operation comprises causing the at least one processor to:

filter the remote speech signal to produce a first replica signal and a second replica signal;

subtract the first replica signal from the first local speech signal; and subtract the second replica signal from the second local speech signal.

* * * * *